US007129912B2

(12) United States Patent
Otani et al.

(10) Patent No.: US 7,129,912 B2
(45) **Date of Patent: *Oct. 31, 2006**

(54) DISPLAY DEVICE, AND DISPLAY PANEL DRIVING METHOD

(75) Inventors: Eishiro Otani, Yamanashi (JP); Kimio Amemiya, Yamanashi (JP); Yoichi Sato, Yamanashi (JP); Tsutomu Tokunaga, Yamanashi (JP)

(73) Assignees: Pioneer Corporation, Tokyo-to (JP); Pioneer Display Products Corporation, Shizuoka-ken (JP)

( * ) Notice: Subject to any disclaimer, the term of this patent is extended or adjusted under 35 U.S.C. 154(b) by 335 days.

This patent is subject to a terminal disclaimer.

(21) Appl. No.: 10/615,938

(22) Filed: Jul. 10, 2003

(65) Prior Publication Data

US 2004/0008164 A1 Jan. 15, 2004

(30) Foreign Application Priority Data

Jul. 12, 2002 (JP) ..... 2002-204695

(51) Int. Cl.
*G09G 3/28* (2006.01)
*G09G 5/00* (2006.01)

(52) U.S. Cl. ..... 345/66; 345/208

(58) Field of Classification Search ..... 345/60, 345/66, 74.1–75.2; 315/169.3, 169.4
See application file for complete search history.

(56) References Cited

U.S. PATENT DOCUMENTS 6,281,863 B1 8/2001 Sasaki et al.
6,313,580 B1 11/2001 Makino
6,344,715 B1 * 2/2002 Tokunaga et al. ..... 345/60
2002/0050960 A1 * 5/2002 Setoguchi et al. ..... 345/60
2003/0067425 A1 * 4/2003 Tokunaga et al. ..... 345/60

FOREIGN PATENT DOCUMENTS

CN 1397979 A 2/2003
EP 1 276 131 A2 1/2003
EP 1 294 006 A2 3/2003
JP 2002-150949 A 5/2002

OTHER PUBLICATIONS

Chinese Office Action.
Korean Office Action.

* cited by examiner

*Primary Examiner*—Richard Hjerpe
*Assistant Examiner*—William Boddie
(74) *Attorney, Agent, or Firm*—Sughrue Mion, PLLC

(57) ABSTRACT

A display panel device includes a plurality of row electrode pairs and a plurality of column electrodes. Each row electrode pair includes a first and second electrodes. Unit light emission areas are formed at intersections of the row electrode pairs and the column electrodes. Each unit light emission area includes a first discharge cell and a second discharge cell. The second discharge cell includes a light-absorbing layer and secondary electron emission material layer. When driving the display panel device, sustain discharge responsible for light emission governing the display image is induced in the first discharge cells, whereas reset discharge and address discharge accompanied by light emission not contributing to the display image is induced in the second discharge cells.

24 Claims, 13 Drawing Sheets

DISPLAY DEVICE, AND DISPLAY PANEL DRIVING METHOD

BACKGROUND OF THE INVENTION

1. Field of the Invention

This invention relates to a display device including a display panel.

2. Description of the Related Art

In recent years, plasma display devices having surface-discharge type AC plasma display panels have attracted attention. The plasma display panel is one kind of large, thin color display panels.

Referring to FIG. 1 to FIG. 3 of the accompanying drawings, a conventional surface-discharge AC plasma display panel will be briefly described. FIG. 1 illustrates a portion of the configuration of a conventional surface-discharge AC plasma display panel. FIG. 2 illustrates a cross sectional view taken along the line 2—2 in FIG. 1. FIG. 3 illustrates a cross sectional view taken along the line 3—3 in FIG. 1.

FIG. 2 is first referred to. In a plasma display panel (PDP), discharge is caused in each of pixels between a front glass substrate 21 and rear glass substrate 24 positioned in parallel. The surface of the front glass substrate 21 is the display surface. On the rear-surface side of the front glass substrate 21, a plurality of row electrode pairs (X',Y') extend in a longitudinal direction (i.e., the width or horizontal direction) of the display panel. A dielectric layer 22 covers the row electrode pairs (X',Y'), and a protective layer (MgO) 23 covers the dielectric layer 22. Each row electrode X', Y' includes a wide transparent electrode Xa', Ya', made from ITO or other transparent conductive film, and a thin (narrow) bus electrode Xb', Yb', made from metal film. The electrode Xb', Yb' supplements the conductivity of the associated electrode Xa', Ya'. As best seen in FIG. 1, the row electrodes X' and Y' are placed in alternation with discharge gaps g'. The electrodes X' and Y' are spaced in the vertical direction (or the height direction) of the display screen. Each row electrode pair (X',Y') forms one display line (row or horizontal line) L of the matrix display. The row electrodes X' and Y' extend in parallel to each other. As illustrated in FIG. 3, a plurality of column electrodes D' are provided on the rear glass substrate 24 such that the column electrode D' extend in the direction orthogonal to the row electrode pairs X', Y'. Band-shaped barrier walls 25 are formed between the column electrodes D'. The barrier walls 25 are parallel to each other. Fluorescent layer 26 formed from red (R), green (G), and blue (B) fluorescent materials cover the side walls of the barrier walls 25 and the column electrodes D'. Between the protective layer 23 and fluorescent layers 26 exist discharge spaces S', within which is sealed an Ne—Xe gas containing xenon. In each display line L, discharge spaces S' are partitioned by the barrier walls 25 at the portions of intersection of column electrodes D' and row electrode pairs (X',Y'), to form discharge cells C' as unit emission areas.

As one method of expressing halftones sequentially to form an image on the surface-discharge AC PDP, the so-called subfield method is employed. Specifically, when display data is N-bit data, the display interval for one field is divided into N subfields such that each subfield emits light a number of times based on a weighting of the corresponding bit in N bits of the display data.

The subfield method is described with reference to FIG. 4. Each subfield comprises a simultaneous reset interval Rc, addressing interval Wc, and sustain interval Ic. In the simultaneous reset interval Rc, reset pulses RPx and RPy are simultaneously applied to the row electrodes $X_1'$ to $X_n'$ and $Y_1'$ to $Y_n'$ so that reset discharge is induced simultaneously in all discharge cells, and a prescribed amount of wall electric charge is formed within each of the discharge cells. Then, in the addressing interval Wc, a scan pulse SP is applied in succession to the row electrodes $Y_1'$ to $Y_n'$ in each row electrode pair, and display data pulses $DP_1$ to $DP_n$ are applied, corresponding to the image display data for each display line, to the column electrodes $D_1'$ to $D_m'$ to induce address discharge (selective extinction discharge). At this time, all discharge cells are divided, corresponding to the image display data, into emission cells in which the wall charge remains without the occurrence of extinction discharge, and non-emission cells in which extinction discharge occurs and the wall charge is annihilated. Next, in the sustain interval Ic, sustain pulses IPx, IPy are applied to the row electrodes $X_1'$ to $X_n'$ and $Y_1'$ to $Y_n'$ a number of times corresponding to the subfield weighting. As a result, only discharge cells in which wall charge remains repeat sustain discharge a number of times corresponding to the number of applied sustain pulses IPx, IPy. Due to this sustain discharge, vacuum ultraviolet light of wavelength 147 nm is emitted from the xenon (Xe) sealed within the discharge space S'. This vacuum ultraviolet light excites the red (R), green (G) and blue (B) fluorescent layer formed on the rear substrate so that visible light is emitted, and an image corresponding to the input image signal is obtained.

In the above described image formation in the PDP, the reset discharge is performed prior to the beginning of the address discharge and sustain discharge in order to stabilize the address discharge and sustain discharge. Further, the address discharge is also performed for each subfield. In the conventional PDP, the reset discharge and address discharge are performed within the discharge cells C' in which visible light is emitted in order to form an image through sustained discharge. Hence light emission appears on the display screen due to reset discharge and address discharge even when expressing black and other dark image colors. This makes the screen brighter and often degrades contrast.

SUMMARY OF THE INVENTION

An object of the present invention is to provide a display device and a display panel driving method which can improve contrast.

According to one aspect of the present invention, there is provided an improved display device for displaying an image corresponding to an input image signal, using pixel data of pixels of the input image signal. The display device includes a display panel, an addressing unit and a sustaining unit. The display panel includes a front, substrate and rear substrate positioned in opposition such that a discharge space is formed between the front substrate and rear substrate. The display panel also include a plurality of row electrode pairs provided on an inner surface of the front substrate such that each row electrode pair defines a display line, and a plurality of column electrodes arranged on an inner surface of the rear substrate such that the column electrode intersect the row electrode pairs. A unit light emission area including a first discharge cell and a second discharge cell is formed at each intersecting portion of the row electrode pairs and the column electrodes. The second discharge cell has a light-absorbing layer and a secondary electron emission material layer. The addressing unit applies scan pulses sequentially to one of the row electrodes in each of the row electrode pairs and applies a pixel data pulse derived from the pixel data to each of the column electrodes, for one display line at a time, with the same timing as the scan pulse, to selectively induce address discharge in the second discharge cells, thereby setting the first discharge cells into either a lit state or into an extinguished state. The sustaining unit repeatedly applies a sustain pulse to each of the row electrode pairs to induce sustain discharge only in those of the first discharge cells which are in the lit state.

According to another aspect of the present invention, there is provided an improved method for driving a display panel based on pixel data of each pixel of an input image signal. The display panel includes a front substrate and rear substrate placed in opposition enclosing a discharge space. The display panel also includes a plurality of row electrode pairs provided on an inner surface of the front substrate such that one row electrode pair define one display line, and a plurality of column electrodes arranged on an inner surface of the rear substrate to intersect the row electrode pairs such that a unit light emission area is formed at each intersecting portion of the row electrode pairs and the column electrodes. The unit light emission area has a first discharge cell and a second discharge cell, and the second discharge cell has a light-absorbing layer and a secondary electron emission material layer. The method includes an addressing step and sustain step. In the addressing step, while applying sequentially a scan pulse to one row electrode of each of the row electrode pairs, pixel data pulses corresponding to the pixel data are applied to the column electrodes one display line at a time with the same timing as the scan pulse, to selectively induce address discharge in the second discharge cells, thereby setting the first discharge cells into either a lit state or into an extinguished state. In the sustain step, a sustain pulse is repeatedly applied to each of the row electrode pairs to induce sustain discharge only in those of the first discharge cells which are in the lit state.

Other objects, aspects and advantages of the present invention will become apparent to those skilled in the art when the following detailed description and the appended claims are read and understood in conjunction with the accompanying drawings.

DETAILED DESCRIPTION OF THE INVENTION

Below, details of an embodiment of this invention are described with reference to the drawings.

Figure 1:
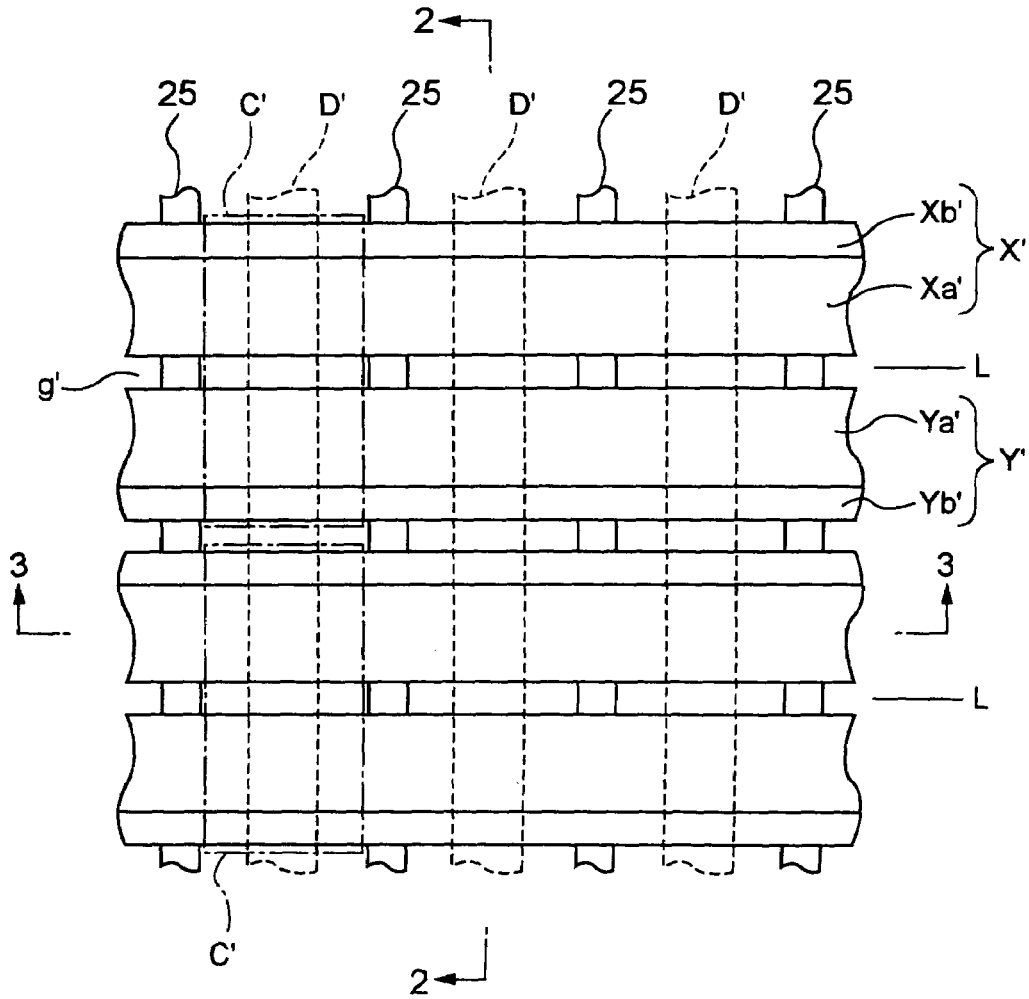
PRIOR ART FIG. 1
FIG. 1 shows a portion of the configuration of a conventional surface-discharge AC plasma display panel.
Figure 2:
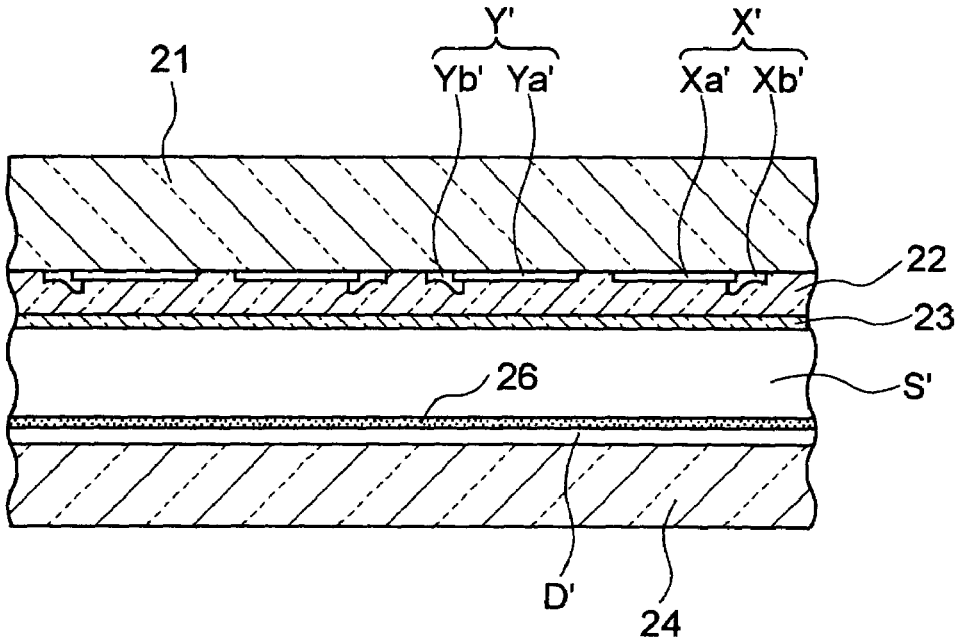
PRIOR ART FIG. 2
FIG. 2 shows a cross-section taken along the line 2—2 in FIG. 1.
Figure 3:
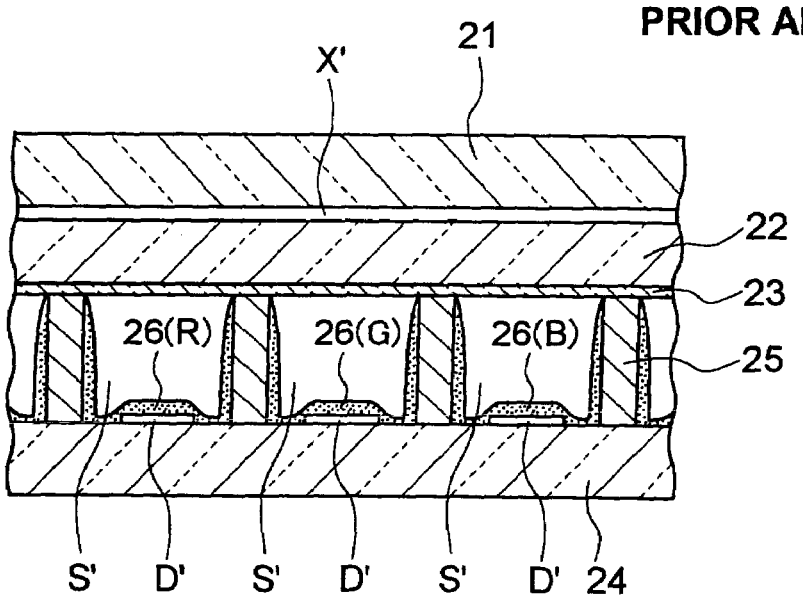
FIG. 3 PRIOR ART
FIG. 3 shows a cross-section taken along the line 3—3 in FIG. 1.
Figure 4:
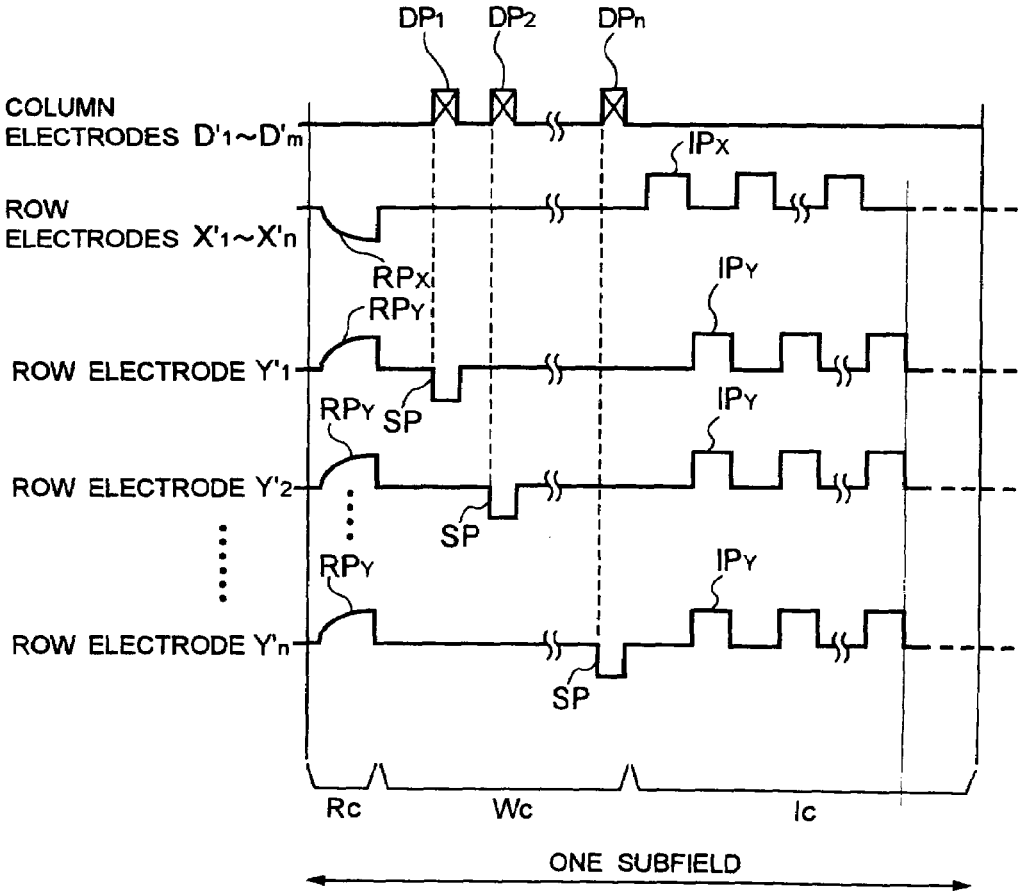
FIG. 4 PRIOR ART
FIG. 4 shows various driving pulses applied to a plasma display panel within one subfield, and the application timing thereof.
Figure 5:
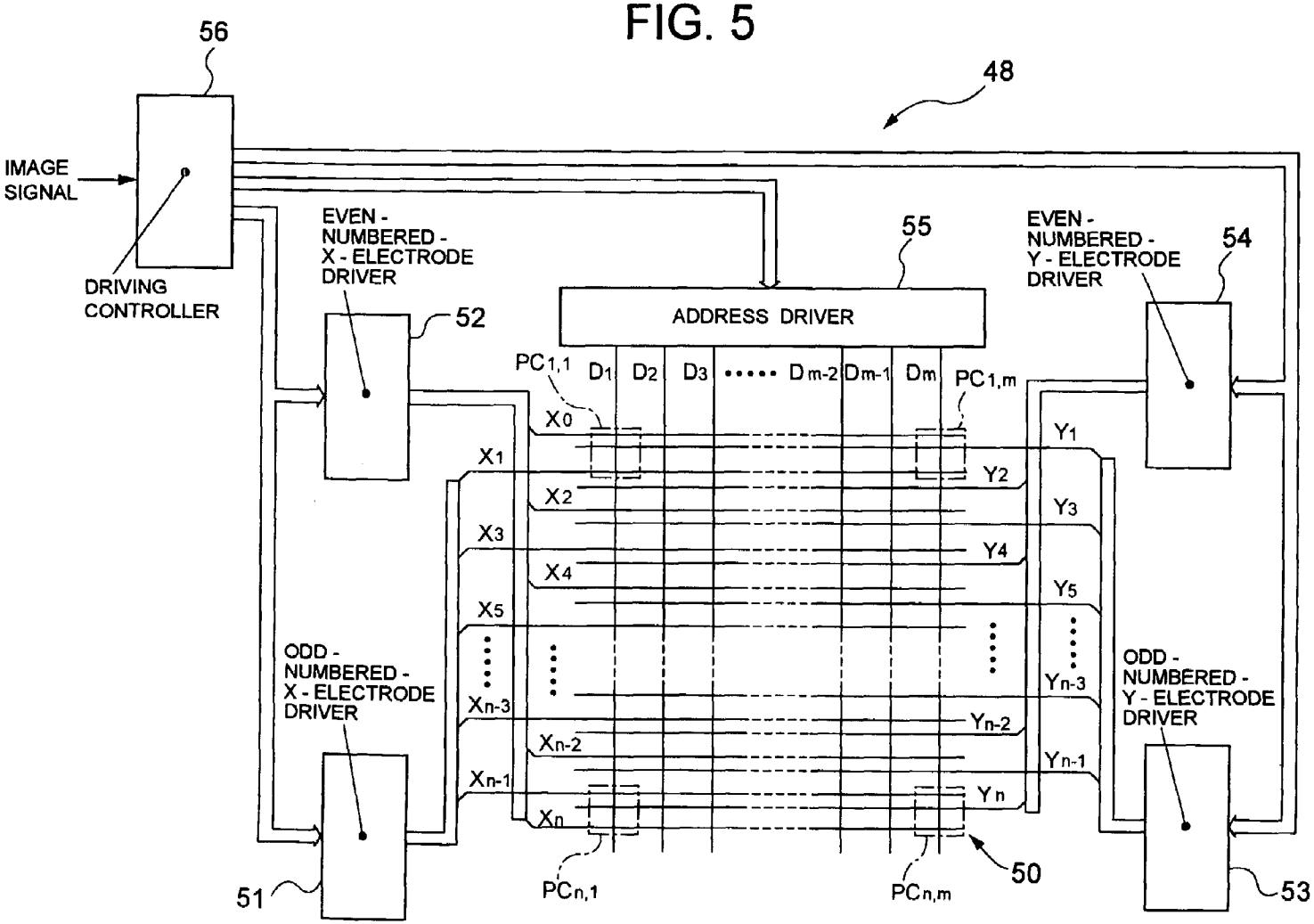
FIG. 5 shows the configuration of a plasma display panel (PDP) device as a display device according to one embodiment of the present invention.

Referring first to FIG. 5, the configuration of a plasma display device 48 as a display device of this invention is illustrated.

As shown in this drawing, the plasma display device 48 includes a plasma display panel or PDP 50, an odd-numbered X-electrode driver 51, an even-numbered X-electrode driver 52, odd-numbered Y-electrode driver 53, an even-numbered Y-electrode driver 54, an address driver 55, and a driving control circuit 56.

Band-shaped column electrodes $D_1$ to $D_m$, extending in the vertical direction of the display screen, are formed in the PDP 50. Further, band-shaped row electrodes $X_0$, $X_1$ to $X_n$ and $Y_1$ to $Y_n$, extending in the horizontal direction of the display screen, are formed in the PDP 50. Each pair of row electrodes, that is, each of the row electrode pairs $(X_1,Y_1)$ to $(X_n,Y_n)$, respectively defines one of the first display line to the nth display line in the PDP 50. Unit emission areas, that is, pixel cells PC serving as pixels, are formed at intersections of the display lines with the column electrodes $D_1$ to $D_m$. In other words, as shown in FIG. 5, pixel cells $PC_{1,1}$ to $PC_{n,m}$ are arranged in a matrix in the PDP 50. The row electrode $X_0$ is included in each of the pixel cells $PC_{1,1}$ to $PC_{1,m}$ of the first display line.

Figure 6:
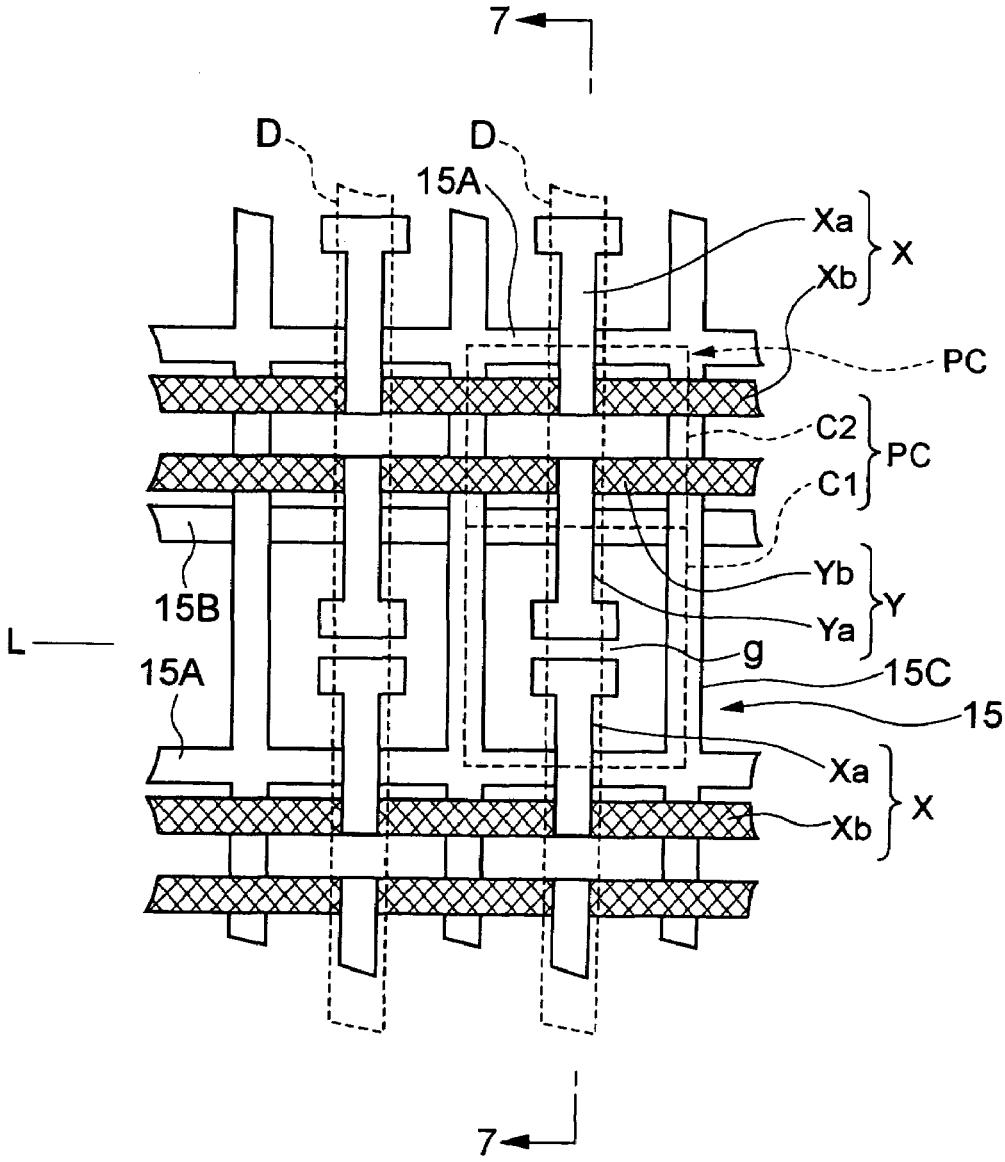
FIG. 6 is a plane view showing a portion of the PDP shown in FIG. 5, seen from the display surface side of the PDP.
Figure 7:
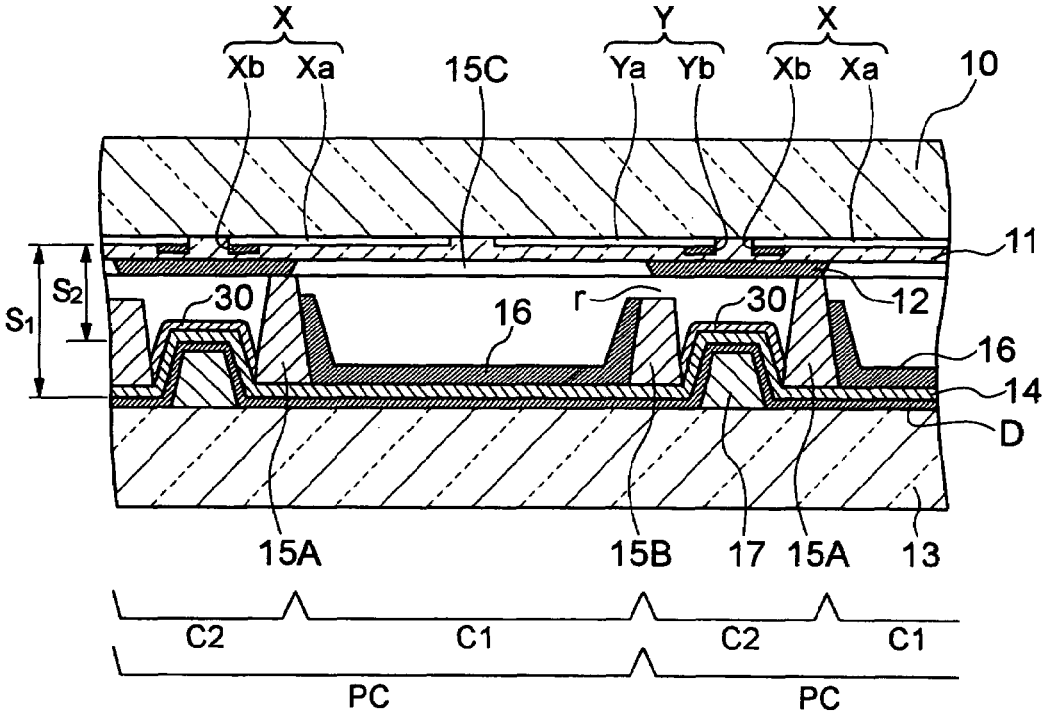
FIG. 7 illustrates a cross sectional view taken along the line 7—7 in, FIG. 6.
Figure 8:
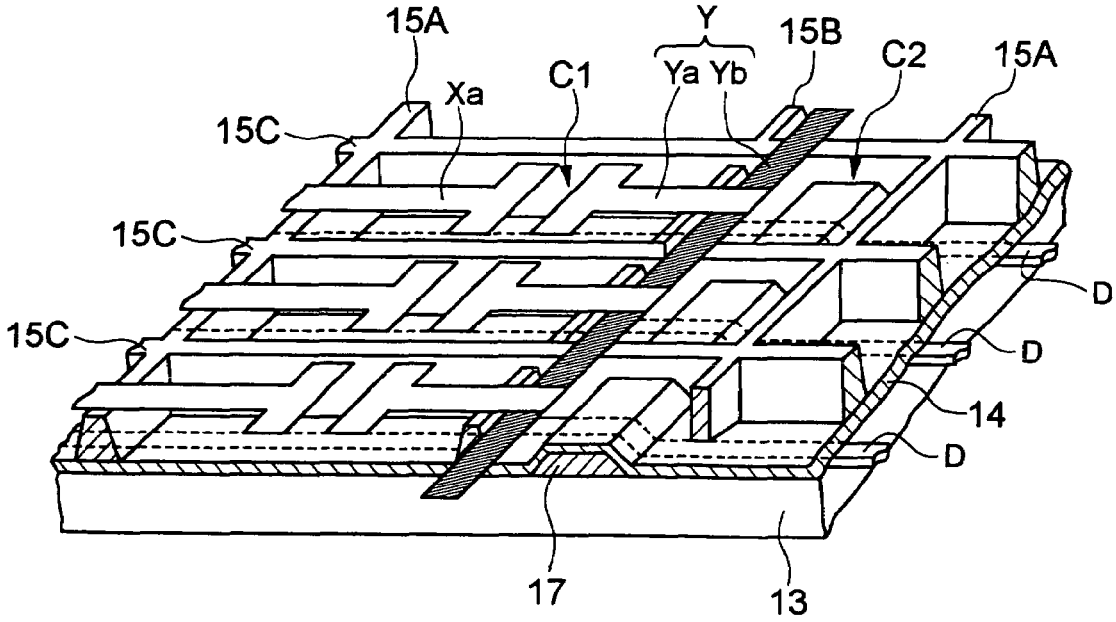
FIG. 8 shows the PDP as seen from obliquely above the display surface of the PDP.

FIG. 6 to FIG. 8 are partial extracts of the internal structure of the PDP 50.

As shown in FIG. 7, various structures, comprising the column electrodes D and row electrodes X and Y to cause discharge at desired pixels, are formed between the front glass substrate 10 and rear glass substrate 13 of the PDP 50. The front glass substrate 10 is parallel to the rear glass substrate 13. The top surface of the front glass substrate 10 is the display surface, and on the bottom surface, a plurality of row electrode pairs (X,Y) are arranged in parallel in the horizontal direction of the display screen (the horizontal direction in FIG. 5).

Each row electrode X includes a plurality of transparent electrodes Xa of ITO or other transparent conductive film formed in a T-shape, and a black bus electrode Xb (the main portion of the row electrode X) of metal film. The bus electrode Xb is a band-shaped electrode extending in the horizontal direction of the display screen. As best seen in FIG. 6, a narrow base (thin leg) portion of the T-shaped transparent electrode Xa extends in the vertical direction of the display screen and is connected to the bus electrode Xb. The transparent electrodes Xa are connected to the bus electrode Xb at positions corresponding to the column electrodes D. The transparent electrodes Xa extend in the vertical direction of the display screen, like the column electrodes D. In other words, the transparent electrodes Xa of the row electrode X are protruding electrode tips which protrude, from the positions on the band-shaped bus electrode Xb corresponding to the column electrodes D, toward the associated electrode Y of the electrode pair. Likewise, each row electrode Y includes a plurality of transparent electrodes Ya of ITO or other transparent conductive film formed in a T-shape, and a black bus electrode Yb (the main portion of the row electrode Y) of metal film. The bus electrode Yb is a band-shaped electrode extending in the horizontal direction in the display screen. The narrow base portion of each transparent electrode Ya extends in the vertical direction of the display screen and is connected to the bus electrode Yb. The transparent electrodes Ya are connected to the bus electrode Yb at positions corresponding to the column electrodes D. That is, the transparent electrodes Ya of the row electrode Y are protruding electrode tips which protrude, from the positions on the bus electrode Yb corresponding to the column electrodes D, toward the associated electrode X of the electrode pair. The row electrodes X and Y are arranged in alternation, spaced from each other in the vertical direction of the glass substrate 10 (the vertical direction in FIG. 6, and the horizontal direction in FIG. 7). The transparent electrodes Xa and Ya are arranged in parallel at equal intervals along the bus electrodes Xb and Yb, respectively. Each transparent electrode Xa of the row electrode X extends towards the corresponding transparent electrode Ya of the row electrode Y of the row electrode pair concerned. The wide head portions of the mating transparent electrodes Xa and Ya are spaced from each other by a discharge gap g of prescribed value.

Referring back to FIG. 7, a dielectric film 11 is formed on the rear surface of the front glass substrate 10 so as to cover the row electrode pairs (X,Y). Raised dielectric layers 12, protruding from the dielectric layer 11 toward the rear side (downwards in FIG. 7), are formed at positions on the surface of the dielectric layer 11 corresponding to the control discharge cells C2 (described below). Each dielectric layer 12 includes a light-absorbing layer containing a black or dark-colored pigment, and extends in parallel to the bus electrodes Xb and Yb. The surfaces of the raised dielectric layers 12 and of the dielectric layer 11 at which the raised dielectric layers 12 are not formed are covered by a protective layer of MgO (not shown). Protruding ribs 17 are formed on the rear glass substrate 13 positioned in parallel with the front glass substrate 10 with a discharge space intervening, at positions opposing the raised dielectric layers 12. The protruding ribs 17 extend in the horizontal direction of the display screen. The column electrodes D extend in the direction (the vertical direction) perpendicular to the bus electrodes Xb and Yb, and are positioned on the rear glass substrate 13. The column electrodes D are in parallel, with a prescribed interval therebetween. As shown in FIG. 8, the column electrodes D on the rear glass substrate 13 are covered with a white column electrode protective layer (dielectric layer) 14.

As shown in FIG. 7, secondary electron emission material layers 30 are formed on the surface of the column electrode protection layer 14, at those portions which protrude due to the protruding ribs 17. The secondary electron emission material layer 30 is a layer comprising high-γ material, which has a low work function (for example, 4.2 eV or lower) and a high secondary electron emission coefficient. Materials which may be used for the secondary electron emission material layer 30 are, for example, MgO, CaO, SrO, BaO, and other alkaline earth metal oxides; $Cs_2O$ and other alkaline metal oxides; $CaF_2$, $MgF_2$, and other fluoride compounds; $TiO_2$ and $Y_2O$; or, materials which have an increased secondary electron emission coefficient through crystal defects or impurity doping.

A barrier wall matrix 15 comprising first horizontal walls 15A, second horizontal walls 15B, and vertical walls 15C is formed on the column electrode protective layer 14. Each second horizontal wall 15B extends in the horizontal direction of the display screen along the side of the bus electrode Yb which is paired with the bus electrode Xb in each row electrode X, if viewed from the side of the front glass substrate 10. Each first horizontal wall 15A also extends in the horizontal direction along the side of the bus electrode Xb which is paired with the bus electrode Yb in each row electrode Y. The first and second horizontal walls 15A and 15B are in parallel with each other at a prescribed distance. The vertical walls 15C extend in the vertical direction of the display screen between the transparent electrodes Xa, Ya. The transparent electrodes Xa, Ya are positioned at equal intervals, spaced in the direction of the bus electrodes Xb, Yb.

The height of the first horizontal wall 15A is equal to the height of the vertical wall 15C, and equal to the distance between the protective layer covering the rear side of the raised dielectric layer 12 and the column electrode protective layer 14 covering the column electrode D. Thus, the first horizontal walls 15A and the vertical walls 15C both abut the rear side of the protective layer covering the raised dielectric layer 12. On the other hand, the height of the second horizontal wall 15B is slightly lower than the height of the first horizontal wall 15A (or the vertical wall 15C). In other words, the second horizontal walls 15B do not abut the protective layer covering the raised dielectric layer 12, and consequently there exists a gap r, as shown in FIG. 7, between the second horizontal wall 15B and the protective layer covering the raised dielectric layer 12.

As shown in FIG. 6, the rectangular area (indicated by the broken line) surrounded by the two first horizontal walls 15A and the two vertical walls 15C defines each pixel cell PC used to form a pixel. The pixel cell PC is partitioned by the second horizontal wall 15B into a display discharge cell C1 and a control discharge cell C2. Discharge gas is sealed into the display discharge cell C1 and control discharge cell C2, and the cells C1 and C2 are communicated with each other via the gap r.

Each display discharge cell C1 includes a pair of opposing transparent electrodes Xa and Ya. That is, within the display discharge cell C1, the transparent electrode Xa of the row electrode X and the transparent electrode Ya of the mating row electrode Y in the row electrode pair (X,Y) defining a single display line, to which the pixel cell PC belongs, oppose across the discharge gap g. For example, a transparent electrode Xa of the row electrode $X_2$ and a transparent electrode Ya of the row electrode $Y_2$ exist within each of the display discharge cells C1 of the pixel cells $PC_{2,1}$ to $PC_{2,m}$ on the second display line.

Each control discharge cell C2 includes a protruding rib 17, bus electrodes Xb, Yb, a secondary electron emission material layer 30, and a raised dielectric layer 12. The bus electrode Yb present within the control discharge cell C2 is the bus electrode of the row electrode Y in the row electrode pair (X,Y) defining the display line of the pixel cell PC. The bus electrode Xb present within the same control discharge cell C2 is the bus electrode of the row electrode X for an adjacent display line above the display line of the pixel cell PC. For example, within each of the control discharge cells C2 of the pixel cells $PC_{2,1}$ to $PC_{2,m}$ of the second display line, the bus electrode Yb of the row electrode $Y_2$ of this second display line, and the bus electrode Xb of the row electrode $X_1$ of the first display line (i.e., the upper display line) are present. Since no display line exists above the first display line, the row electrode Xo is provided in the PDP 50. The row electrode $X_0$ extends above the row electrode $Y_1$ of the first display line. In other words, the bus electrode Yb of the row electrode $Y_1$ of the first display line, and the bus electrode Xb of the row electrode $X_0$ are present within each of the control discharge cells C2 of the pixel cells $PC_{1,1}$ to $PC_{1,m}$ of the first display line.

The fluorescent layer 16 is formed so as to cover five surfaces facing the discharge space of each display discharge cell C1: the side face of the first horizontal wall 15A, the side face of the second horizontal wall 15B and the two side faces of the vertical walls 15C, and the top surface of the column electrode protective layer 14. As the fluorescent layer 16, there are three types: a red fluorescent layer which emits red light, a green fluorescent layer which emits green light, and a blue fluorescent layer which emits blue light. Allocation of the red, green and blue fluorescent layers is determined depending upon locations of the pixel cells PC. Such a fluorescent layer is not formed within the control discharge cells C2.

On the rear glass substrate 13, the band-shaped protruding ribs 17 extend through the control discharge cells C2 in the horizontal direction of the display screen. The height of each protruding rib 17 is lower than that of the second horizontal wall 15B. By means of the protruding rib 17, the, column electrodes D, column electrode protective layer 14, and secondary electron emission material layer 30 are lifted from the rear glass substrate 13 within each control discharge cell C2, as shown in FIG. 7. Hence the gap s2 between the column electrode D and bus electrode Xb (Yb) in a control discharge cell C2 is smaller than the gap s1 between the column electrode D and the transparent electrode Xa (Ya) in a display discharge cell C1. The protruding ribs 17 may be formed from the same dielectric material as the column electrode protective layer 14, or may be created by sand-blasting, wet etching or another method to form depressions and protrusions on the rear glass substrate 13.

In the PDP 50, therefore, the pixel cells $PC_{1,1}$ to $PC_{n,m}$ are sealed by the barrier wall grid 15 (first horizontal walls 15A and vertical walls 15C) placed between the front glass substrate 10 and rear glass substrate 13 so that the pixel cells $PC_{1,1}$ to $PC_{n,m}$ are arranged in a matrix. As mentioned earlier, each pixel cell PC includes a display discharge cell C1 and control discharge cell C2 such that the discharge space of the display discharge cell C1 is communicated with the discharge space of the control discharge cell C2. Driving of the $PC_{1,1}$ to $PC_{n,m}$ via the row electrodes $X_0$, $X_1$ to $X_n$, row electrodes $Y_1$ to $Y_n$, and column electrodes $D_1$ to $D_m$ will be described below.

The odd-numbered X-electrode driver 51 applies driving pulses (described below) to the odd-numbered row electrodes X of the PDP 50, that is, to the row electrodes $X_1$, $X_3$, $X_5$, . . . , $X_{n-3}$, and $X_{n-1}$, according to a timing signal supplied by the driving control circuit 56. The even-numbered X electrode driver 52 applies driving pulses (described below) to the even-numbered row electrodes X of the PDP 50, that is, to the row electrodes $X_0$, $X_2$, $X_4$, . . . , $X_{n-2}$, and $X_n$, according to a timing signal supplied by the driving control circuit 56. The odd-numbered Y-electrode driver 53 applies driving pulses (described below) to the odd-numbered row electrodes Y of the PDP 50, that is, to the row electrodes $Y_1$, $Y_3$, $Y_5$, . . . , $Y_{n-3}$, and $Y_{n-1}$, according to a timing signal supplied by the driving control circuit 56. The even-numbered Y electrode driver 54 applies driving pulses (described below) to the even-numbered row electrodes Y of the PDP 50, that is, to the row electrodes $Y_2$, $Y_4$, . . . , $Y_{n-2}$, and $Y_n$, according to a timing signal supplied by the driving control circuit 56. The address driver 55 applies driving pulses (described below) to the column electrodes $D_1$ to $D_m$ of the PDP 50, according to a timing signal supplied by the driving control circuit 56.

The driving control circuit 56 divides each of the fields (frames) of the image signal into N subfields SF1 to SFN and drives (or controls) the PDP 50 using the subfields. This drive scheme is called a "subfield (subframe) method." The driving control circuit 56 first converts the input image signal into pixel data representing the brightness levels of respective pixels. Then, the driving control circuit 56 converts the pixel data into a pixel driving data bit group DB1 to DBN determining whether light emission should take place in the subfields SF1 to SFN, and feeds the pixel driving data bit group to the address driver 55.

Figure 9:
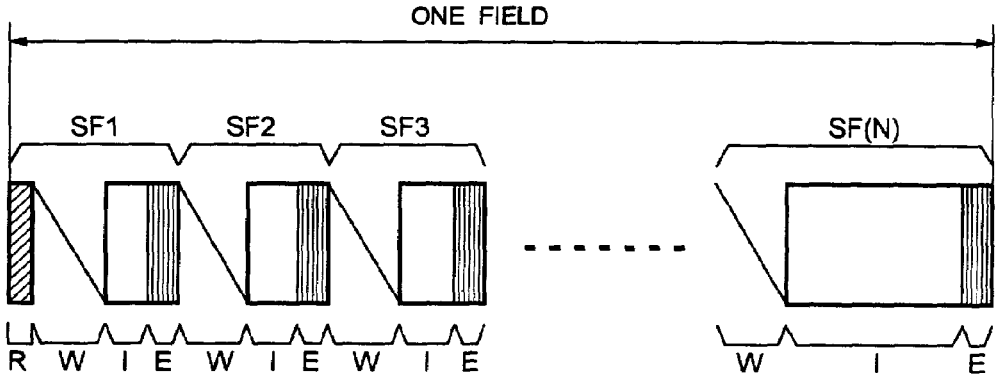
FIG. 9 shows an example of an emission driving sequence to drive the PDP when adopting a selective writing addressing method.

The driving control circuit 56 generates various timing signals to control the driving of the PDP 50 according to the light emission driving sequence shown in FIG. 9, and supplies the timing signals to the odd-numbered X-electrode driver 51, even-numbered X-electrode driver 52, odd-numbered Y-electrode driver 53, and even-numbered Y-electrode driver 54.

In the light emission driving sequence shown in FIG. 9, the addressing step W, sustain step I, and erase step E are executed sequentially in each of the subfields SF1 to SFN. It should be noted, however, that a reset step R is executed prior to the addressing step W only in the leading subfield SF1.

Figure 10:
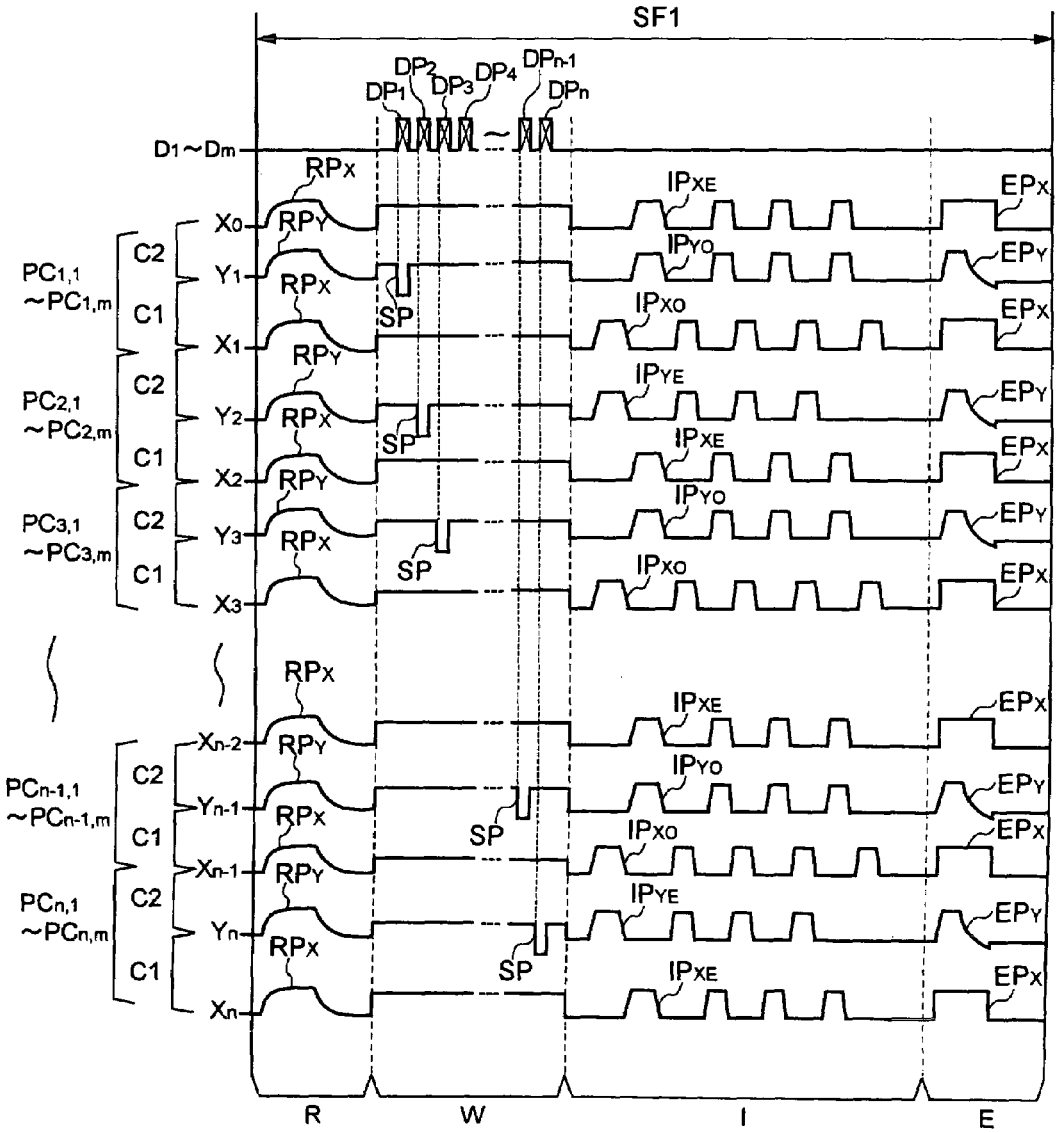
FIG. 10 shows various driving pulses applied to the PDP in a first subfield according to the emission driving sequence shown in FIG. 9, and the application timing thereof.
Figure 11:
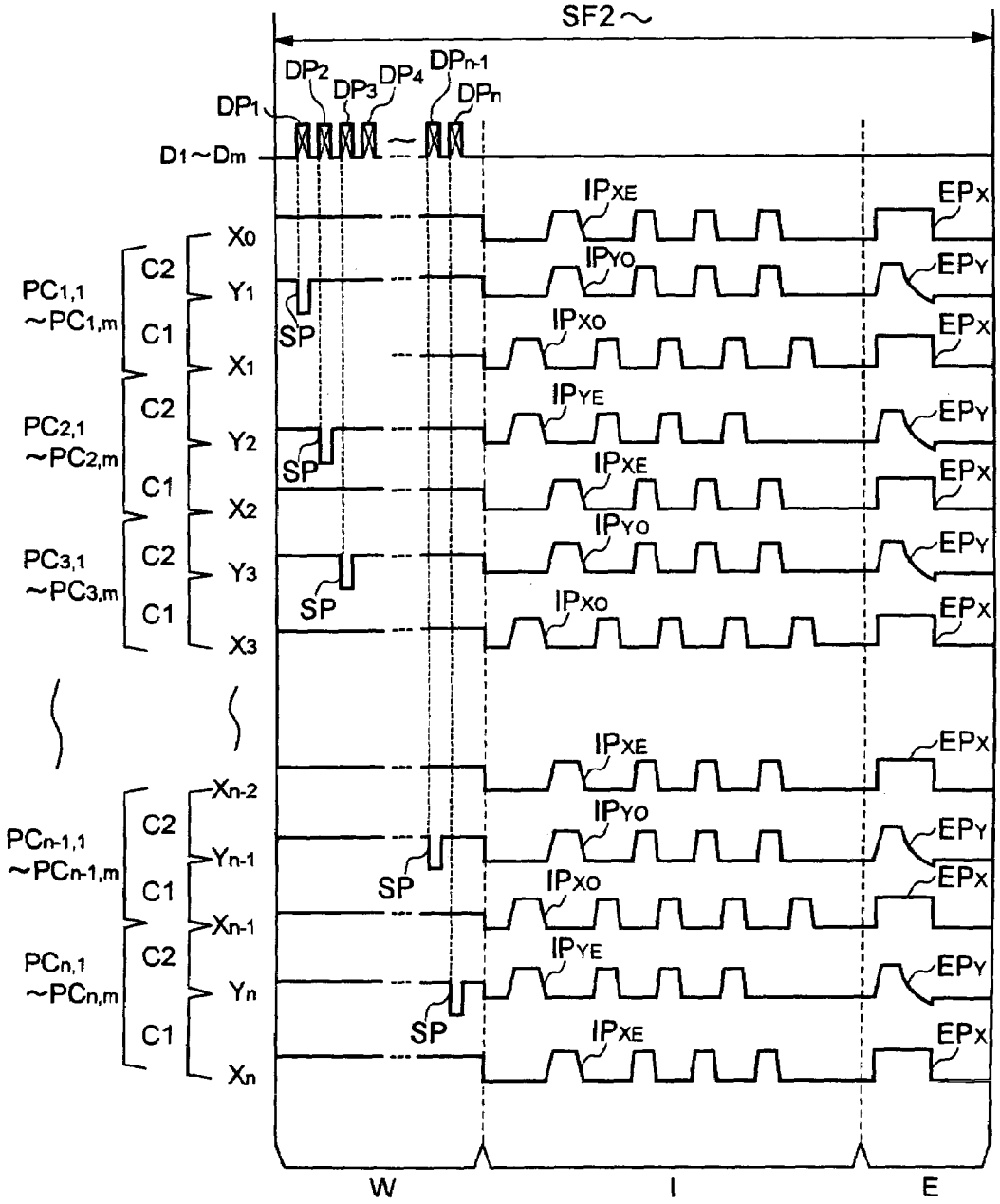
FIG. 11 shows various driving pulses applied to the PDP within a subsequent subfield according to the emission driving sequence shown in FIG. 9, and the application timing thereof.

FIG. 10 shows the various driving pulses, and the application timing thereof, applied to the PDP 50 in the subfield SF1 by the odd-numbered X-electrode driver 51, even-numbered X-electrode driver 52, odd-numbered Y-electrode driver 53, even-numbered Y-electrode driver 54, and address driver 55. FIG. 11 shows the various driving pulses, and the application timing thereof, applied to the PDP 50 in each of the subfields SF2 to SFN by the odd-numbered X-electrode driver 51, even-numbered X-electrode driver 52, odd-numbered Y-electrode driver 53, even-numbered Y-electrode driver 54, and address driver 55. In the reset step R of the subfield SF1, the odd-numbered X-electrode driver 51 and even-numbered X-electrode driver 52 generate positive-voltage reset pulses $RP_x$ having a waveform as shown in FIG. 10, and apply these reset pulses to the row electrodes $X_0$ to $X_n$ simultaneously. Further, simultaneously with application of the reset pulses $RP_x$, the odd-numbered Y-electrode driver 53 and even-numbered Y-electrode driver 54 generate positive-voltage reset pulses $RP_y$ having a waveform as shown in FIG. 10, and apply these reset pulses to the row electrodes $Y_1$ to $Y_n$ simultaneously. The level transitions during the rising interval and falling interval of each of the reset pulses $RP_x$ and $RP_y$ (i.e., the rising inclination and the falling inclination of the reset pulse) are more gradual than the level transitions during the rising interval and falling interval of a sustain pulse IP (described below). In response to application of the reset pulses $RP_x$ and $RP_y$, reset discharge is induced across the bus electrode Xb and column electrode D, and across the bus electrode Yb and column electrode D, within each of the control discharge cells C2 of all the pixel cells $PC_{1,1}$ to $PC_{n,m}$. After the end of this reset discharge, negative-polarity wall charge is formed in the vicinity of the bus electrodes Xb and Yb, and positive-polarity wall charge is formed in the vicinity of the column electrode D, within each control discharge cell C2 of all of the pixel cells $PC_{1,1}$ to $PC_{n,m}$. As a result, all the pixel cells PC are brought into the extinguished state.

In this way, by causing the reset discharge mainly within the control discharge cells C2 of the pixel cells PC during the reset step R, all the pixel cells PC are initialized to the extinction (light off) state.

In the addressing step W in each of the subfields SF1 to SFN, the odd-numbered Y-electrode driver 53 and even-numbered Y-electrode driver 54 generate negative-voltage scan pulses SP in alternation, and apply the scan pulses SP in succession to the row electrodes $Y_1, Y_2, Y_3, \ldots, Y_{n-1}$, and $Y_n$, as shown in FIG. 10 and FIG. 11. In the meantime, the address driver 55 converts the pixel driving data bit groups DB for the subfields SF having the addressing steps W concerned, into pixel data pulses DP having pulse voltages corresponding to the logic levels of the respective data bits. For example, the address driver 55 converts a pixel driving data bit with logic level 1 into a positive-polarity high-voltage pixel data pulse DP, and converts a pixel driving data bit with logic level 0 into a low-voltage (0 volt) pixel data pulse DP. Such pixel data pulses DP are applied to column electrodes $D_1$ to $D_m$, for one display line at a time, in sync with the timing of application of the scan pulses SP. During this pixel data pulse application, the odd-numbered X-electrode driver 51 and even-numbered X-electrode driver 52 continue to apply a positive-polarity voltage to the row electrodes $X_1$ to $X_n$, as shown in FIG. 10 and FIG. 11. In the addressing step W, the addressing discharge (selective write discharge) is induced across the column electrode D and bus electrode Yb within the control discharge cell C2 of a pixel cell PC to which the scan pulse SP is applied and a high-voltage pixel data pulse DP is applied. Here, a positive-polarity voltage is applied to all of the row electrodes $X_0$ to $X_n$, so that the discharge is extended to the display discharge cell C1 via the gap r shown in FIG. 7. As a result, negative-polarity wall charge is formed in the vicinity of the transparent electrode Xa within the display discharge cell C1, and positive-polarity wall charge is formed in the vicinity of the transparent electrode Ya, so that the pixel cell PC of this display discharge cell C1 is set in the lit state. On the other hand, the address discharge (selective write discharge) is not induced within the control discharge cell C2 of the pixel cell PC to which a scan pulse SP is applied but a high-voltage pixel data pulse DP is not applied. Consequently the wall charge is not formed in the display discharge cell C1 linked via the gap r, and so the pixel cell PC of this display discharge cell C1 is set to the extinguished state.

As described above, by selectively causing addressing discharge in the control discharge cell C2 of the pixel cell PC according to pixel data during the addressing step W, wall charge of different polarities is formed in the vicinities of the transparent electrodes Xa and Ya within the display discharge cell C1. Thus, each pixel cell PC is set to either the lit state or to the extinguished state according to the pixel data.

Next, in the sustain step I of each subfield, the odd-numbered Y-electrode driver 53 repeatedly applies a positive-voltage sustain pulse $IP_{YO}$ as shown in FIG. 10 (FIG. 11), for the number of times allocated to the subfield of the sustain step I concerned, to each of the odd-numbered row electrodes $Y_1, Y_3, Y_5, \ldots, Y_{(n-1)}$. Also, in the sustain step I, the even-numbered X-electrode driver 52 repeatedly applies a positive-voltage sustain pulse $IP_{XE}$, with the same timing as the sustain pulse $IP_{YO}$, for the number of times allocated to the subfield of the sustain step I, to each of the even-numbered row electrodes $X_0, X_2, X_4, \ldots, X_{n-2}$, and $X_n$. Also, in the sustain step I, the odd-numbered X-electrode driver 51 repeatedly applies a positive-voltage sustain pulse $IP_{XO}$ as shown in FIG. 10 (FIG. 11), for the number of times allocated to the subfield of the sustain step I, to each of the odd-numbered row electrodes $X_1, X_3, X_5, \ldots, X_{(n-1)}$). Also, in the sustain step I, the even-numbered Y-electrode driver 54 repeatedly applies a positive-voltage sustain pulse $IP_{YE}$, with the same timing as the sustain pulse $IP_{XO}$, for the number of times allocated to the subfield of the sustain step I, to each of the even-numbered row electrodes $Y_2, Y_4, \ldots, Y_{n-2}$, and $Y_n$. As shown in FIG. 10 (FIG. 11), the application timing is shifted for the sustain pulses $IP_{XE}$ and $IP_{YO}$ and for the sustain pulses $IP_{XO}$ and $IP_{YE}$. In the sustain step I, each time the sustain pulses $IP_{XO}$ and $IP_{YO}$ are applied in alternation, and each time $IP_{XE}$ and $IP_{YE}$ are applied in alternation, sustain discharge is induced across the transparent electrodes Xa and Ya within the display discharge cell C1 of a pixel cell PC set to the lit state. By means of the ultraviolet rays generated by the sustain discharge, the fluorescent layer 16 (red fluorescent layer, green fluorescent layer, blue fluorescent layer) formed in the display discharge cell C1 is excited, and light corresponding to the fluorescence color is radiated through the front glass substrate 10. That is, light emission is induced repeatedly by the sustain discharge, for the number of times allocated to the subfield of the sustain step I. In the control discharge cell C2, on the other hand, the sustain pulses $IP_{XO}$ and $IP_{YE}$ (or $IP_{XE}$ and $IP_{YO}$) are applied in the same phase across the bus electrodes Xb and Yb, so that no sustain discharge is repeatedly induced.

As described above, in the sustain step I only those pixel cells PC which are set to the lit state are caused to emit light repeatedly the number of times allocated to the subfield.

Next, in the erase step E of each subfield, the odd-numbered Y-electrode driver 53 and even-numbered Y-electrode driver 54 apply erase pulses $EP_Y$ having a waveform shown in FIG. 10 (FIG. 11) to the row electrodes $Y_1$ to $Y_n$ of the PDP 50. Further, simultaneously with application of the erase pulses $EP_Y$, the odd-numbered X-electrode driver 51 and even-numbered X-electrode driver 52 apply erase pulses $EP_X$ having a waveform shown in FIG. 10 (FIG. 11) to the row electrodes $X_1$ to $X_n$ of the PDP 50. The level transition of an erase pulse $EP_Y$ when falling is gradual, as shown in FIG. 10 (FIG. 11). In response to application of the erase pulses $EP_Y$ and $EP_X$, erase discharge is induced within the display discharge cell C1 and control discharge cell C2 of a pixel cell PC, which has been set to the lit discharge state, as the erase pulse $EP_Y$ falls. By means of the erase discharge, the wall charge formed within the display discharge cell C1 and control discharge cell C2 is annihilated. In other words, all the pixel cells PC in the PDP 50 are brought into the extinguished state.

As a result of the above-described driving, a halftone brightness corresponding to the total of the number of light emissions caused in the sustain steps I through the subfields SF1 to SFN is perceived. That is, the discharge light caused upon the sustain discharge induced in the sustain step I within each subfield creates a display image corresponding to the input image signal.

In the plasma display device 48 shown in FIG. 5, therefore, while the sustain discharge related to (contributing to) the display image is induced within the display discharge cells C1 of the pixel cells PC, the reset discharge and address discharge, which emit light but do not contribute to the display image, are induced mainly in the control discharge cells C2. As shown in FIG. 7, the raised dielectric layer 12 (i.e., the light-absorbing layer containing black or dark-colored pigment) is provided in the control discharge cells C2. The discharge light accompanying the reset discharge and address discharge is blocked by the raised dielectric layer 12, so that this discharge light does not appear in the display surface via the front glass substrate 10.

Also, in the plasma display device 48, the secondary electron emission material layer 30 is provided on the rear glass substrate 13 in only the control discharge cell C2 of the pixel cell PC, as shown in FIG. 7. There is no layer 30 in the display discharge cell C1 of the pixel cell PC. By means of the secondary electron emission material layer 30, the discharge initiation voltage and discharge sustain voltage across the column electrode D and row electrode Y within the control discharge cell C2 are lower than the discharge initiation voltage and discharge sustain voltage across the column electrode D and row electrode Y within the display discharge cell C1. That is, the discharge initiation voltage and discharge sustain voltage are higher for the display discharge cell C1 than for the control discharge cell C2. Hence even if the discharge induced within the control discharge cell C2 extends to the display discharge cell C1 via the gap r, the discharge induced within the display discharge cell C1 will be feeble, and the brightness of emitted light accompanying this discharge will also be extremely low. Also, by means of the secondary electron emission material layer 30, discharge is induced on the side of the rear glass substrate 13 in the control discharge cell C2, so that the ultraviolet light accompanying this discharge leaks into the display discharge cell C1 in a reduced amount.

Hence the plasma display device 48 can suppress light emission accompanying reset discharge and address discharge which does not contribute to the display image, so that the contrast of the displayed image, and in particular the dark contrast when displaying images of overall dark scenes, can be increased.

In the above-described embodiment (FIG. 9 to FIG. 11), a selective write addressing method is adopted as a pixel data writing method to determine the wall charge formation in each pixel cell of the PDP 50 based on the pixel data. The selective write addressing method induces address discharge to create wall charge selectively in pixel cells based on pixel data. It should be noted, however, that the invention may adopt a so-called selective erase addressing method as the method of pixel data writing. The selective erase addressing method forms wall charge within all pixel cells in advance, and selectively erases the wall charge within pixel cells by address discharge.

Figure 12:
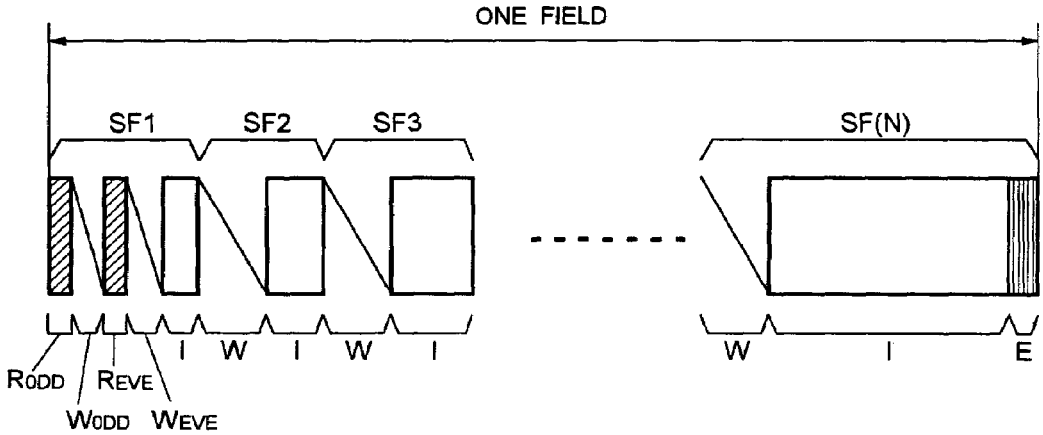
FIG. 12 shows an example of an emission driving sequence to drive the PDP when a selective erase addressing method is employed.

FIG. 12 shows an emission driving sequence when adopting a selective erase addressing method.

In the emission driving sequence of FIG. 12, the leading subfield SF1 has the odd-numbered row reset step $R_{ODD}$, odd-numbered row addressing step $W_{ODD}$, even-numbered reset step $R_{EVE}$, even-numbered row addressing step $W_{EVE}$, and sustain step I, which are executed sequentially. In each of the subfields SF2 to SFN, the addressing step W and sustain step I are executed. Further, in the final subfield SFN, after execution of the sustain step I, an erase step E is executed.

Figure 13:
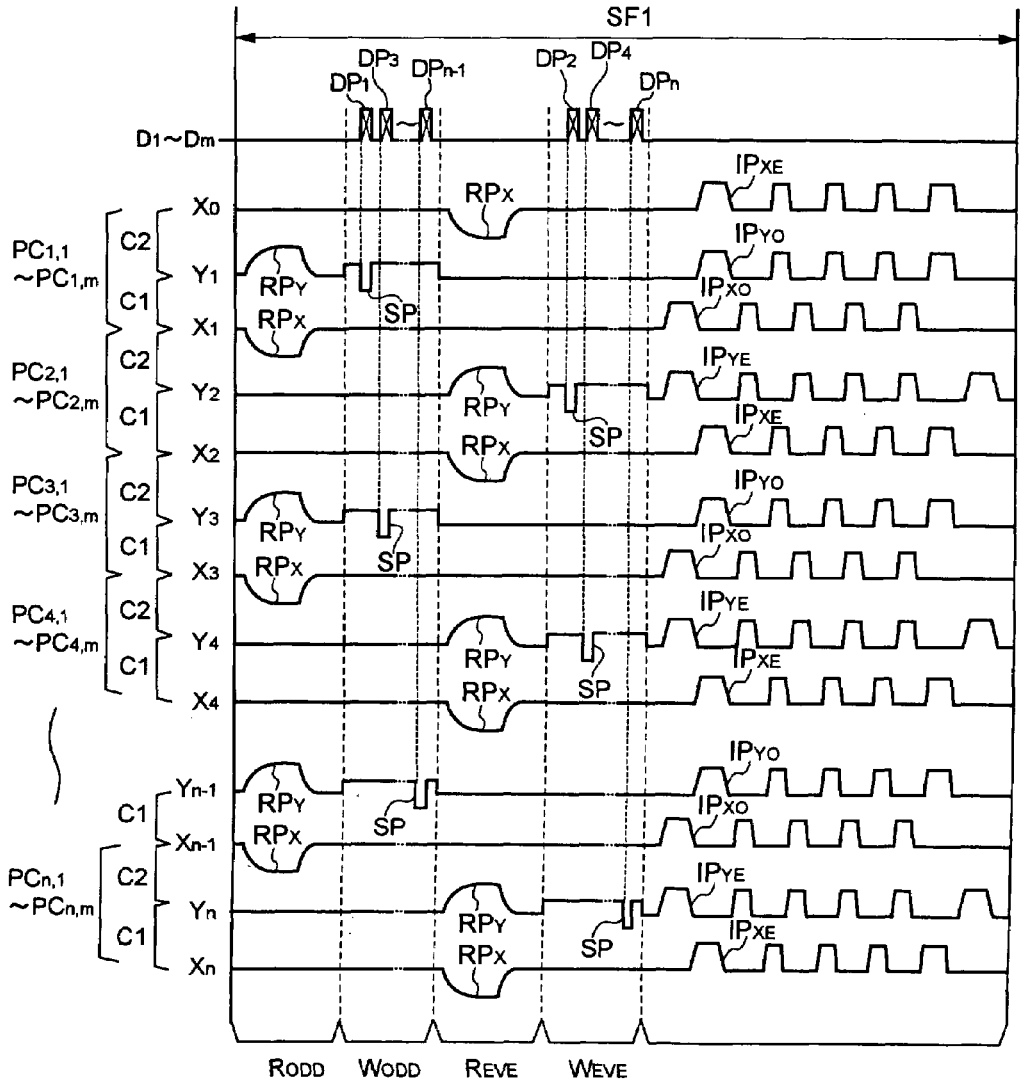
FIG. 13 shows the various driving pulses applied to the PDP within the first subfield according to the emission driving sequence shown in FIG. 12, and the application timing thereof.
Figure 14:
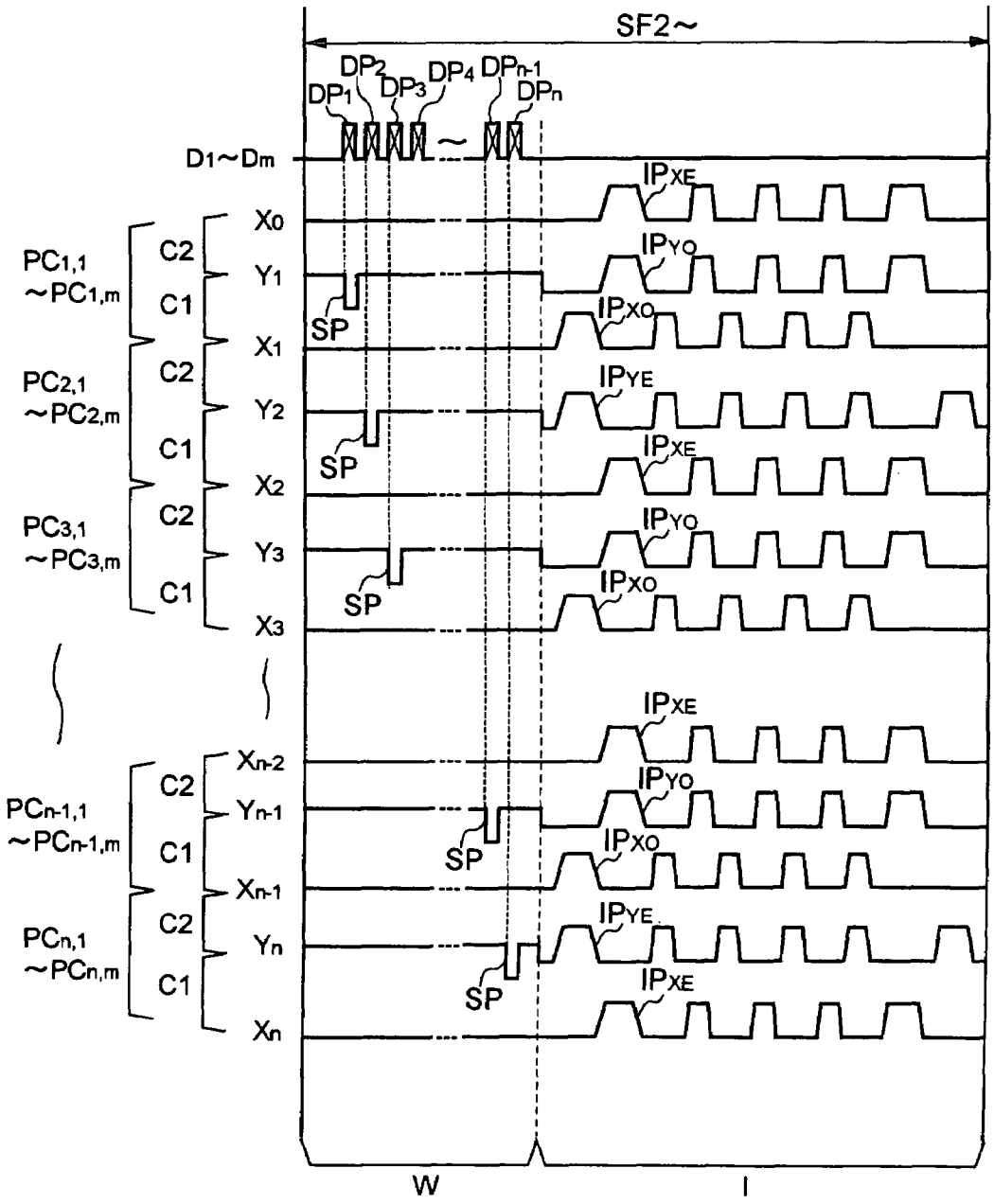
FIG. 14 shows the various driving pulses applied to a PDP within each of the subfield SF2 and subsequent subfields according to the emission driving sequence shown in FIG. 12, and the application timing thereof.

FIG. 13 shows various driving pulses applied to the PDP 50 in the subfield SF1, as well as the application timing thereof. FIG. 14 shows the various driving pulses applied to the PDP 50 during the addressing step W and sustain step I of the subfields SF2 to SFN, and the application timing thereof.

In the odd-numbered row reset step $R_{ODD}$ of the subfield SF1, the odd-numbered Y-electrode driver 53 simultaneously applies positive-voltage reset pulses $RP_Y$ having a waveform shown in FIG. 13 to the odd-numbered row electrodes $Y_1$, $Y_3$, $Y_5$, . . . , $Y_{n-3}$, and $Y_{n-1}$ of the PDP 50. Also in the odd-numbered row reset step $R_{ODD}$, the odd-numbered X-electrode driver 51 simultaneously applies negative-voltage reset pulses $RP_X$ having a waveform shown in FIG. 13 to the odd-numbered row electrodes $X_1$, $X_3$, $X_5$, . . . , $X_{n-3}$, and $X_{n-1}$ of the PDP 50. The absolute value of the voltage of the reset pulses $RP_X$ is smaller, than the absolute value of the voltage of the reset pulses $RP_Y$. Also, the level transition during the rising and falling intervals of the reset pulses $RP_X$ and $RP_Y$ is more gradual than the level transition during the rising and falling intervals of sustain pulses IP, described below. Upon application of the reset pulses $RP_X$ and $RP_Y$, reset discharge is induced across the bus electrodes Yb and column electrodes D within the control discharge cells C2 of the pixel cells $PC_{1,1}$ to $PC_{1,m}$, $PC_{3,1}$ to $PC_{3,m}$, $PC_{5,1}$ to $PC_{5,m}$, . . . , $PC_{(n-1),1}$ to $PC_{(n-1),m}$ in odd-numbered display lines. Further, the reset discharge extends via the gap r shown in FIG. 7 to the display discharge cell C1, so that reset discharge is induced across the transparent electrodes Xa and Ya within the display discharge cells C1 of each of the pixel cells PC in the odd-numbered display lines. After the end of this reset discharge, positive-polarity wall charge is formed in the vicinity of the bus electrodes Xb in the control discharge cells C2, negative-polarity wall charge is formed in the vicinity of the bus electrode Yb, and positive-polarity wall charge is formed in the vicinity of the column electrode D in the control discharge cell C2. As a result, the pixel cell PC having a control discharge cell C2 in which the reset discharge is induced enters the lit state.

Thus in an odd-numbered row reset step $R_{ODD}$, by inducing reset discharge in the display discharge cells C1 and control discharge cells C2 of all the pixel cells PC in the odd-numbered display lines of the PDP 50, all the pixel cells PC in the odd-numbered display lines are initialized to the lit state.

Next, in the odd-numbered row addressing step $W_{ODD}$ of the subfield SF1, the odd-numbered Y-electrode driver 53 applies a negative-voltage scan pulse SP sequentially to the odd-numbered row electrodes $Y_1$, $Y_3$, $Y_5$, . . . , $Y_{n-3}$, and $Y_{n-1}$ of the PDP 50. During the application of the scan pulse SP, the address driver 55 converts those bits corresponding to odd-numbered display lines in the pixel driving data bit groups DB for the subfields SF having the odd-numbered row addressing steps $W_{ODD}$ into pixel data pulses DP having pulse voltages corresponding to the logic levels of the data bits. For example, the address driver 55 converts pixel driving data bits at logic level 1 into positive-polarity high-voltage pixel data pulses DP, and converts pixel driving data bits at logic level 0 into low-voltage (0 volt) pixel data pulses DP. These pixel data pulses DP are then applied, one display line at a time, to column electrodes $D_1$ to $D_m$ in sync with the application of the scan pulses SP. In other words, the address driver 55 converts pixel driving data bits $DB_{1,1}$ to $DB_{1,m}$, $DB_{3,1}$ to $DB_{3,m}$, . . . , $DB_{(n-1),1}$ to $DB_{(n-1),m}$ corresponding to odd-numbered display lines into pixel data pulses $DP_{1,1}$ to $DP_{1,m}$, $DP_{3,1}$ to $DP_{3,m}$, . . . , $DP_{(n-1),1}$ to $DP_{(n-1),m}$, and applies these data pulses to the column electrodes $D_1$ to $D_m$, one display line at a time. Here, address discharge (selective erase discharge) is induced across the column electrode D and bus electrode Yb within the control discharge cells C2 of the pixel cell PC in an odd-numbered display line if a scan pulse SP and a high-voltage pixel data pulse DP are both applied. After the end of this address discharge, the wall charge formed within the control discharge cell C2 is annihilated. In the meanwhile, the address discharge extends to the display discharge cell C1 via the gap r shown in FIG. 7. Consequently, feeble address discharge is also induced across the transparent electrodes Xa and Yb of the display discharge cell C1, and the wall charge which had been formed within this display discharge cell C1 is annihilated. As a result of annihilation of the wall charge in the display discharge cell C1, the pixel cell PC of this display discharge cell C1 is set to the extinguished state. On the other hand, address discharge is not induced within a control discharge cell C2 of a pixel cell PC to which a high-voltage pixel data pulse DP has not been applied, even though a scan pulse SP has been applied. Hence the address discharge is not induced in the display discharge cell C1 linked to such control discharge cell C2 via the gap r, and so wall charge remains within this display discharge cell C1. Accordingly, the pixel cell PC having a display discharge cell C1 and control discharge cell C2 in which address discharge has not been induced is set to the lit state.

As described above, in the odd-numbered row addressing step $W_{ODD}$, by selectively inducing the address discharge, depending upon pixel data, in pixel cells PC on an odd-numbered display line, wall charge existing within the display discharge cells C1 can be selectively annihilated. Thus, each of the pixel cells PC on odd-numbered display lines can be set to either the lit state or the extinguished state, based on the pixel data.

In the even-numbered row reset step $R_{EVE}$ of the subfield SF1, the even-numbered Y-electrode driver 54 simultaneously applies positive-voltage reset pulses $RP_Y$, having a waveform shown in FIG. 13, to the even-numbered row electrodes $Y_2$, $Y_4$, . . . , $Y_{n-2}$, and $Y_n$ of the PDP 50. Also, in the even-numbered row reset step $R_{EVE}$, the even-numbered X-electrode driver 52 simultaneously applies negative-voltage reset pulses $RP_X$, having a waveform shown in FIG. 13, to the even-numbered row electrodes $X_0$, $X_2$, $X_4$, . . . , $X_{n-2}$, and $X_n$ of the PDP 50. The absolute value of the voltage of the reset pulses $RP_X$ is smaller than the absolute value of the voltage of the reset pulses $RP_Y$. The level transitions during the rising and falling intervals of each of the reset pulses $RP_X$ and RPare more gradual than the level transitions of sustain pulses IP, described below, during the rising and falling intervals. Upon application of the reset pulses $RP_X$ and $RP_Y$, reset discharge is induced across the bus electrode Yb and column electrode D within the control discharge cell C2 of each of the pixel cells $PC_{2,1}$ to $PC_{2,m}$, $PC_{4,1}$ to $PC_{4,m}$, $PC_{6,1}$ to $PC_{6,m}$, . . . , and $PC_{n,1}$ to $PC_{n,m}$ on the odd-numbered display lines. This reset discharge is extended to the display discharge cell C1 from the control discharge cell C2 via the gap r shown in FIG. 7, so that reset discharge is also induced across the transparent electrodes Xa and Ya in the display discharge cell C1 of each of the pixel cells PC on the even-numbered display lines. After the completion of this reset discharge, positive-polarity wall charge is formed in the vicinity of the bus electrode Xb in the control discharge cell C2, and negative-polarity wall charge is formed in the vicinity of the bus electrode Yb. Also, positive-polarity wall charge is formed in the vicinity of the column electrode D within the control discharge cell C2. As a result, the pixel cell PC having a control discharge cell C2 in which reset discharge has been induced is put into the lit state.

As described above, in the even-numbered row reset step $R_{EVE}$, the reset discharge is caused in the display discharge cells C1 and control discharge cells C2 of all pixel cells PC in the even-numbered display lines of the PDP 50, so that all the pixel cells PC in the even-numbered display lines can be initialized to the lit state.

In the even-numbered row addressing step $W_{VEE}$ of the subfield SF1, the even-numbered Y-electrode driver 54 applies, sequentially, negative-voltage scan pulses SP to the even-numbered row electrodes $Y_2$, $Y_4$, . . . , $Y_{n-2}$, and $Y_n$ of the PDP 50. In the meantime, the address driver 55 converts those bits corresponding to even-numbered display lines in the pixel driving data bit groups DB for the subfields SF having the even-numbered row addressing steps $W_{EVE}$, into pixel data pulses DP having pulse voltages corresponding to the logic levels of the data bits. For example, the address driver 55 converts a pixel driving data bit at logic level 1 into a positive-polarity high-voltage pixel data pulse DP, and converts a pixel driving data bit at logic level 0 into a low-voltage (0 volt) pixel data pulse DP. These pixel data pulses DP are then applied, one display line at a time, to the column electrodes $D_1$ to $D_m$ in sync with the application of the scan pulses SP. In other words, the address driver 55 converts pixel driving data bits $DB_{2,1}$ to $DB_{2,m}$, $DB_{4,1}$ to $DB_{4,m}$, . . . , $DB_{n,1}$ to $DB_{n,m}$ corresponding to even-numbered display lines into pixel data pulses $DP_{2,1}$ to $DP_{2,m}$, $DP_{4,1}$ to $DP_{4,m}$, . . . , $DP_{n,1}$ to $DP_{n,m}$, and applies these pixel data pulses to the column electrodes $D_1$ to $D_m$, one display line at a time. Here, address discharge (selective erase discharge) is induced across the column electrode D and bus electrode Yb within the control discharge cell C2 of a pixel cell PC in an even-numbered display line if a scan pulse SP has been applied to that pixel cell PC and a high-voltage pixel data pulse DP has also been applied to the pixel cell PC. After the end of this address discharge, the wall charge formed within the control discharge cell C2 is annihilated. In the meantime, the address discharge propagates to the display discharge cell C1 from the control discharge cell C2 via the gap r shown in FIG. 7. As a result, address discharge is also induced across the transparent electrodes Xa and Yb of the display discharge cell C1, and the wall charge formed within this display discharge cell C1 is annihilated. As a consequence of annihilation of the wall charge in the display discharge cell C1, the pixel cell PC having such display discharge cell C1 is set to the extinguished state. On the other hand, address discharge is not induced within a control discharge cell C2 of a pixel cell PC to which a high-voltage pixel data pulse DP has not been applied, even though a scan pulse SP has been applied. Hence the address discharge is not induced in the display discharge cell C1 linked to the control discharge cell C2 via the gap r, and so wall charge remains within this display discharge cell C1. Accordingly, a pixel cell PC having a display discharge cell C1 and control discharge cell C2 in which address discharge has not been induced is set to the lit state.

As described above, in the even-numbered row addressing step $W_{EVE}$, the address discharge is selectively caused in pixel cells PC on the even-numbered display lines based on the pixel data, so that wall charge existing within each display discharge cell C1 can be selectively annihilated. In this manner, each of the pixel cells PC in even-numbered display lines can be set to either the lit state or the extinguished state, in accordance with the pixel data.

In the sustain step I in each subfield, the odd-numbered Y-electrode driver 53 repeatedly applies a positive-voltage sustain pulse $IP_{YO}$ as shown in FIG. 13 (FIG. 14) to odd-numbered row electrodes $Y_1, Y_3, Y_5, \ldots, Y_{(n-1)}$ the number of times allocated to the subfield having the sustain step I concerned. The even-numbered X-electrode driver 52 repeatedly applies a positive-voltage sustain pulse $IP_{XE}$ to even-numbered row electrodes $X_0, X_2, X_4, \ldots, X_{n-2}, X_n$ the number of times allocated to the subfield having the sustain step I, with the same timing as the sustain pulses $IP_{YO}$. The odd-numbered X-electrode driver 51 repeatedly applies a positive-voltage sustain pulse $IP_{XO}$ as shown in FIG. 13 (FIG. 14) to odd-numbered row electrodes $X_1, X_3, X_5, \ldots, X_{(n-1)}$ the number of times allocated to the subfield of the sustain step I. And in the sustain step I, the even-numbered Y-electrode driver 54 repeatedly applies a positive-voltage sustain pulse $IP_{XE}$ to even-numbered row electrodes $Y_2, Y_4, \ldots, Y_{n-2}, Y_n$ the number of times allocated to the subfield of the sustain step I. As shown in FIG. 13 (FIG. 14), the timing of application of the sustain pulses $IP_{XE}$ and $IP_{YO}$ is shifted from that of the sustain pulses $IP_{XO}$ and $IP_{YE}$. Each time the sustain pulses $IP_{XO}$, $IP_{XE}$, $IP_{YO}$, $IP_{YE}$ are applied, sustain discharge is induced across the transparent electrodes Xa and Ya within the display discharge cell C1 of a pixel cell PC set to the lit state. Here, due to the ultraviolet light generated by the sustain discharge, the fluorescent layer 16 (red fluorescent layer, green fluorescent layer, blue fluorescent layer) formed in the display discharge cell C1 is excited, and light corresponding to the fluorescence color is irradiated through the front glass substrate 10. That is, light emission is repeatedly induced by the sustain discharge the number of times allocated to the subfield having the sustain step I concerned. Within the control discharge cell C2, sustain pulses $IP_{XO}$ and $IP_{YE}$ (or $IP_{XE}$ and $IP_{YO}$) having the same phase are applied across the bus electrodes Xb and Yb, so that there is no repeated inducement of sustain discharge. By means of the final sustain pulse $IP_{YO}$ applied to each of the odd-numbered row electrodes Y and the final sustain pulse $IP_{YE}$ applied to each of the even-numbered row electrodes Y, positive-polarity wall charge remains in the vicinity of the column electrode D and negative-polarity wall charge remains in the vicinity of the transparent electrode Yb within the display discharge cell C1 after the end of the sustain step I.

As described above, in the sustain step I, only those pixel cells PC which have been set to the lit state in the immediately preceding even-numbered row addressing step $W_{EVE}$, odd-numbered row addressing step $W_{ODD}$, or addressing step W are caused to emit light repeatedly the number of times allocated to the subfield.

In the erase step E executed only in the final subfield SFN, an erase pulse $EP_Y$ is applied to all row electrodes Y and an erase pulse $EP_X$ is applied to all row electrodes X in a similar manner to the erase step E of FIG. 10 (or FIG. 11). Erase discharge is induced in the display discharge cell C1 and control discharge cell C2 when the erase pulse $EP_Y$ falls, and the wall charge formed within the display discharge cell C1 and control discharge cell C2 is annihilated. In other words, all pixel cells PC in the PDP 50 are brought into the extinguished state.

By means of the above-described driving, a halftone brightness corresponding to the total of the number of light emissions executed in each sustain step I, through the subfields SF1 to SFN, is perceived. That is, the discharge light caused upon the sustain discharge induced in the sustain step I within each subfield can create a display image corresponding to the input image (video) signal.

In the driving scheme which adopts the selective erase addressing method as described above and shown in FIG. 12 through FIG. 14, reset discharge accompanied by light emission which does not contribute to the display image is induced in a control discharge cell C2 comprising a raised dielectric layer 12 formed from a light-absorptive layer, and reset discharge is also induced in the display discharge cell C1. Since a secondary electron emission material layer 30 is provided within the control discharge cell C2, the discharge initiation voltage and discharge sustain voltage are higher for the display discharge cell C1 than for the control discharge cell C2. Hence even if discharge induced in the control discharge cell C2 propagates via the gap r into the display discharge cell C1, the discharge induced in the display discharge cell C1 is feeble, and the brightness of emitted light resulting from the discharge is extremely low. Also, because the secondary electron emission material layer 30 is present, discharge is induced on the side of the rear glass substrate in the control discharge cell C2, so that the ultraviolet rays produced upon the discharge leak into the display discharge cell C1 in a reduced amount.

Hence even though the PDP 50 adopts the selective erase addressing method, only a minute amount of discharge light generated upon the reset discharge and address discharge appears in the display surface via the front glass substrate 10, so that dark contrast can be increased.

Figure 15:
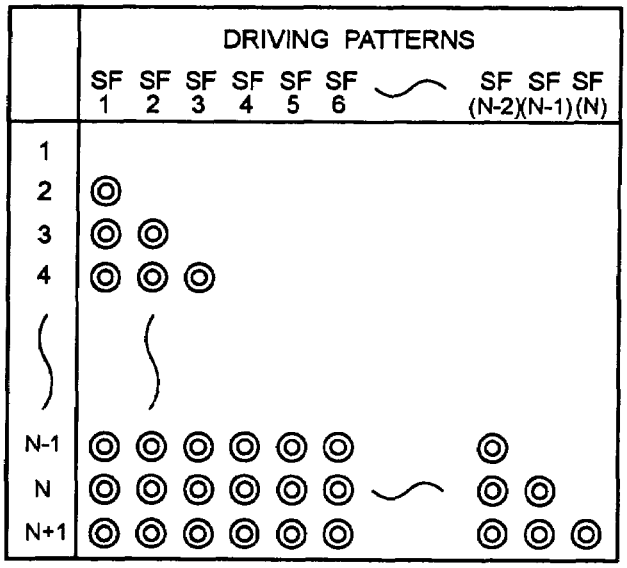
FIG. 15 shows an example of a driving pattern within one field to drive the PDP with N+1 halftones when the selective write addressing method is employed; and, FIG. 16 shows an example of a driving pattern within one field to drive the PDP with N+1 halftones when the selective erase addressing method is employed.

FIG. 15 shows the driving pattern for one field (frame) when driving a PDP 50 using the above-described selective write addressing method. As illustrated, the driving pattern includes N+1 types of driving pattern, from a first driving pattern corresponding to the lowest brightness, until the (N+1)th driving pattern corresponding to the highest brightness. The double circle in FIG. 15 indicates that address discharge (selective write discharge) is induced in the addressing step ($W_{ODD}$, $W_{EVE}$) of a subfield concerned, and a pixel cell is caused to emit light repeatedly in the sustain step of the same subfield. On the other hand, in a subfield without the double-circle symbol address discharge (selective write discharge) is not induced, and so in the sustain step of this subfield the pixel cell PC is in the extinguished state. Hence in the case of, for example, the first driving pattern shown in FIG. 15, there is no emission of light by the pixel cell PC from the subfields SF1 to SFN, so that black, with the lowest brightness, is represented. In the case of the third driving pattern, the pixel cell PC emits light only in the sustain steps of the subfields SF1 and SF2, and so a halftone brightness is represented which corresponds to the total of the number of light emissions allocated to the sustain step of the subfield SF1, and the number of light emissions allocated to the sustain step of the subfield SF2.

Figure 16:
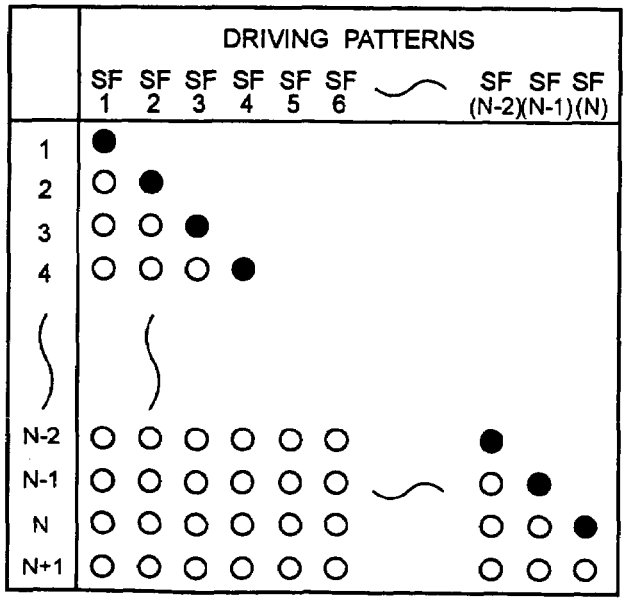

FIG. 16 shows the driving pattern for one field (frame) when driving a PDP 50 using the above-described selective erase addressing method. As shown in the drawing, the driving pattern includes N+1 types of driving pattern, from a first driving pattern corresponding to the lowest brightness, until the (N+1)th driving pattern corresponding to the highest brightness. The black circle indicates that address discharge (selective erase discharge) has been induced during the addressing step ($W_{ODD}$, $W_{EVE}$) of the subfield, the wall charge is formed within the control discharge cell C2, but this wall charge is now annihilated so that the pixel cell PC is set to the extinguished state. On the other hand, the white circle indicates that only a pixel cell PC in the lit state is caused to emit light in the sustain step of the subfield. Hence in the case of, for example, the first driving pattern shown in FIG. 16, a pixel cell PC emits no light at all from the subfields SF1 through SFN, so that black, with the lowest brightness, is represented (displayed). In the case of the third driving pattern, a pixel cell PC emits light only in the sustain steps of the subfields SF1 and SF2, so that a halftone brightness is represented corresponding to the total of the number of light emissions allocated to the sustain step of the subfield SF1, and the number of light emissions allocated to the sustain step of the subfield SF2.

The driving control circuit 56 (FIG. 5) selects and executes, from among the N+1 driving patterns shown in FIG. 15 or FIG. 16, one driving pattern in accordance with the brightness level to be represented by the input image signal. In other words, the pixel driving data bits DB1 to DBN are generated based on the input image signal and are supplied to the address driver 55 such that the driving states shown in FIG. 15 or FIG. 16 are achieved. Consequently, halftone brightness with N+1 brightness levels, represented by the input image signal, can be expressed.

In the illustrated and described embodiment, N+1 halftones are expressed in the PDP 50 using only N+1 driving patterns, as shown in FIG. 15 or FIG. 16, from among $2^N$ different driving patterns representable by N subfields; however, similar manner of control (driving) can be applied when achieving $2^N$ halftones.

In the above-described embodiment, the protruding ribs 17 and secondary electron emission material layers 30 are both provided on the side of the rear substrate 12 within the control discharge cells C2; however, the protruding ribs 17 may be eliminated and only the secondary electron emission material layers 30 may be provided on the inner side walls of the control discharge cells C2 (the inner walls of the partition walls 15A, 15B and 15C facing the discharge space defined in the discharge cells C2) and on the rear substrate 12.

In the illustrated embodiment, black pigment material is incorporated into the raised dielectric layer 12 to obtain a light-absorbing layer, but this invention is not limited to such structure. For example, a black layer (light-absorbing layer) may be formed within the dielectric layer 11, or between the dielectric layer and the front glass substrate 10.

In the above-described embodiment, the second horizontal wall 15B is shorter than the first horizontal wall 15A to create a gap r between the second horizontal wall 15B and the raised dielectric layer 12, thereby linking the discharge space of the control discharge cell C2 to the discharge space of the display discharge cell Cl; however, the structure linking the two discharge spaces is not limited to the above-described structure. For example, the heights of the first horizontal wall 15A and the second horizontal wall 15B may be made the same, and a slit (slot) may be provided in the raised dielectric layer 12 so as to link the discharge spaces of the control discharge cell C2 and the display discharge cell C1.

This application is based on a Japanese patent application No. 2002-204695, and the entire disclosure thereof is incorporated herein by reference.

What is claimed is:

1. A display device which, according to pixel data for each pixel based on an input image signal, displays an image corresponding to the input image signal, comprising:

a display panel, having a front substrate and rear substrate positioned in opposition such that a discharge space is formed between the front substrate and rear substrate, a plurality of row electrode pairs provided on an inner surface of the front substrate such that each row electrode pair defines a display line, and a plurality of column electrodes arranged on an inner surface of the rear substrate such that the plurality of column electrode intersect the plurality of row electrode pairs and such that a unit light emission area including a first discharge cell and a second discharge cell is formed at each intersecting portion of the plurality of row electrode pairs and the plurality of column electrodes, the second discharge cell having a light-absorbing layer and a secondary electron emission material layer such that the secondary electron emission material layer is formed on or near the rear substrate within each of the second discharge cells;

addressing means for applying scan pulses sequentially to one of the row electrodes in each of the row electrode pairs and applying a pixel data pulse derived from the pixel data to each of the column electrodes, for one display line at a time, with the same timing as the scan pulse, to selectively induce address discharge in the second discharge cells, thereby setting the first discharge cells into either a lit state or into an extinguished state;

sustain means for repeatedly applying a sustain pulse to each of the row electrode pairs to induce sustain discharge only in those of the first discharge cells which are in the lit state; and reset means for applying a positive-polarity reset pulse to at least one of two row electrodes in each said row electrode pair, prior to the address discharge caused by the addressing means, to induce reset discharge across the column electrode and the row electrode pair in each second discharge cell.

2. The display device according to claim 1, wherein the light-absorbing layer is formed on or near the front substrate within each of the second discharge cells.

3. The display device according to claim 1, wherein a fluorescent layer is formed only within each of the first discharge cells.

4. The display device according to claim 1, wherein each of the row electrodes in each row electrode pair comprises a main electrode portion extending in a display line direction, and a plurality of electrode tips protruding from the main electrode portion toward the opposite row electrode in the same row electrode pair such that each electrode tip is opposed to a mating electrode tip, the electrode tips protruding from intersecting portions of the main electrode portion and the column electrodes;

each of the first discharge cells comprises two mating electrode tips belonging to one row electrode pair; and each of the second discharge cells comprises the main portion of one row electrode in the one row electrode pair and another main portion of a row electrode in a next row electrode pair.

5. The display device according to claim 1, wherein said reset means applies the positive polarity reset pulse to both said row electrodes, of each said row electrode pair to induce the reset discharge across the column electrode and the row electrode pair in each said second discharge cell.

6. The display device according to claim 1, wherein said reset means applies the positive-polarity reset pulse to one row electrode of each of the row electrode pairs and applies a negative-polarity reset pulse to the other row electrode of each of the row electrode pairs, to induce the reset discharge across the column electrode and the row electrode pair within each said second discharge cell as well as within the associated first discharge cell.

7. The display device according to claim 6, wherein the reset means executes the reset discharge induced in the first discharge cells and the second discharge cells of odd-numbered display lines separated by a time interval from the reset discharge induced in the first discharge cells and the second discharge cells of even-numbered display lines.

8. The display device according to claim 1, wherein the reset pulse has a waveform a level transition of which during a rising interval and falling interval is gradual compared with the sustain pulse.

9. The display device according to claim 1 further comprising erase means for inducing erase discharge within the first discharge cells and the second discharge cells by applying an erase pulse to the row electrodes after the end of the sustain discharge induced by the sustain means.

10. A display panel driving method for driving a display panel based on pixel data of each pixel of an input image signal, the display panel including a front substrate and rear substrate placed in opposition enclosing a discharge space, a plurality of row electrode pairs provided on an inner surface of the front substrate such that one row electrode pair define one display line, and a plurality of column electrodes arranged on an inner surface of the rear substrate to intersect the row electrode pairs such that a unit light emission area is formed at each intersecting portion of the row electrode pairs and the column electrodes, the unit light emission area having a first discharge cell and a second discharge cell, the second discharge cell having a light-absorbing layer and a secondary electron emission material layer such that the secondary electron emission material layer is formed on or near the rear substrate within each of the second discharge cells, the method comprising:

an addressing step, in which, while applying sequentially a scan pulse to one row electrode of each of the row electrode pairs, pixel data pulses corresponding to the pixel data are applied to the column electrodes one display line at a time with the same timing as the scan pulse, to selectively induce address discharge in the second discharge cells, thereby setting the first discharge cells into either a lit state or into an extinguished state;

a sustain step, in which a sustain pulse is repeatedly applied to each of the row electrode pairs to induce sustain discharge only in those of the first discharge cells which are in the lit state; and a reset step for applying a positive-polarity reset pulse to at least one of two row electrodes in each said row electrode pair, prior to the addressing step, to induce reset discharge across the column electrode and the row electrode pair in each second discharge cell.

11. The display panel driving method according to claim 10, wherein said reset step applies the positive-polarity reset pulse to both said row electrodes of each said row electrode pair to induce the reset discharge across the column electrode and the row electrode pair within each said second discharge cell.

12. The display panel driving method according to claim 10, wherein said reset step applies the positive-polarity reset pulse to one row electrode in each of the row electrode pairs, and applies a negative-polarity reset pulse to the other row electrode in the same row electrode pair, to induce the reset discharge across the column electrode and the row electrodes in each of the second discharge cells, and also within each of the first discharge cells.

13. The display panel driving method according to claim 12, wherein the reset step comprises an odd-numbered reset step in which the reset discharge is induced in each of the first discharge cells and the second discharge cells in odd-numbered display lines, and an even-numbered reset step in which the reset discharge is induced in each of the first discharge cells and the second discharge cells in even-numbered display lines.

14. The display panel driving method according to claim 11, wherein the reset pulse has a waveform the level transition of which during the rising interval and falling interval is gradual compared with the sustain pulse.

15. The display panel driving method according to claim 10 further comprising an erase step in which, after the end of the sustain step, erase discharge is caused in the first discharge cells and in the second discharge cells by applying erase pulses to the row electrodes.

16. An apparatus for displaying an image corresponding to an input image signal, using pixel data of pixels of the input image signal, the apparatus comprising:

a display panel, having a front substrate and rear substrate positioned in opposition such that a discharge space is formed between the front substrate and rear substrate, a plurality of row electrode pairs provided on an inner surface of the front substrate such that each row electrode pair defines a display line, and a plurality of column electrodes arranged on an inner surface of the rear substrate such that the plurality of column electrode intersect the plurality of row electrode pairs and such that a unit light emission area including a first discharge cell and a second discharge cell is formed at each intersecting portion of the plurality of row electrode pairs and the plurality of column electrodes, the second discharge cell having a light-absorbing layer and a secondary electron emission material layer such that the secondary electron emission material layer is formed on or near the rear substrate within each said second discharge cell;

an addressing unit for applying scan pulses sequentially to one of the row electrodes in each of the row electrode pairs and applying a pixel data pulse derived from the pixel data to each of the column electrodes, for one display line at a time, with the same timing as the scan pulse, to selectively induce address discharge in the second discharge cells, thereby setting the first discharge cells into either a lit state or into an extinguished state;

a sustain unit for repeatedly applying a sustain pulse to each of the row electrode pairs to induce sustain discharge only in those of the first discharge cells which are in the lit state; and a reset unit for applying a positive-polarity reset pulse to at least one of two row electrodes in each said row electrode pair, prior to the address discharge, to induce reset discharge across the column electrode and the row electrode pair in each said second discharge cell.

17. The apparatus according to claim 16, wherein the light-absorbing layer is formed on or near the front substrate within each of the second discharge cells.

18. The apparatus according to claim 16, wherein a fluorescent layer is formed only within each of the first discharge cells.

19. The apparatus according to claim 16, wherein each of the row electrodes in each row electrode pair comprises a main electrode portion extending in a display line direction, and a plurality of electrode tips protruding from the main electrode portion toward the opposite row electrode in the same row electrode pair such that each electrode tip is opposed to a mating electrode tip, the electrode tips protruding from intersecting portions of the main electrode portion and the column electrodes;

each of the first discharge cells comprises two mating electrode tips belonging to one row electrode pair; and each of the second discharge cells comprises the main portion of one row electrode in the one row electrode pair and another main portion of a row electrode in a next row electrode pair.

20. The apparatus according to claim 16, wherein said a reset unit applies the positive-polarity reset pulse to both said row electrodes of each said row electrode pair to induce the reset discharge across the column electrode and the row electrode pair in each second discharge cell.

21. The apparatus according to claim 20, wherein the reset unit applies the positive-polarity reset pulse to one row electrode of each of the row electrode pairs and applies a negative-polarity reset pulse to the other row electrode of each of the row electrode pairs, to induce the reset discharge across the column electrode and the row electrode pair within each said second discharge cell as well as within the associated first discharge cell.

22. The apparatus according to claim 20, wherein the reset unit executes the reset discharge induced in the first discharge cells and the second discharge cells of odd-numbered display lines separated by a time interval from the reset discharge induced in the first discharge cells and the second discharge cells of even-numbered display lines.

23. The apparatus according to claim 16, wherein the reset pulse has a waveform a level transition of which during a rising interval and falling interval is gradual compared with the sustain pulse.

24. The apparatus according to claim 16 further comprising an erasing unit for inducing erase discharge within the first discharge cells and the second discharge cells by applying an erase pulse to the row electrodes after the end of the sustain discharge induced by the sustain unit.

* * * * *